US008051800B2

(12) United States Patent
Kawakami

(10) Patent No.: US 8,051,800 B2
(45) Date of Patent: Nov. 8, 2011

(54) NANOMATERIAL IMMOBILIZATION METHOD AND IMMOBILIZATION APPARATUS

(75) Inventor: Tomonori Kawakami, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 108 days.

(21) Appl. No.: 12/365,223

(22) Filed: Feb. 4, 2009

(65) Prior Publication Data

US 2009/0197007 A1 Aug. 6, 2009

(30) Foreign Application Priority Data

Feb. 6, 2008 (JP) ..... P2008-026855

(51) Int. Cl.
*B05C 11/00* (2006.01)
*B05B 5/025* (2006.01)

(52) U.S. Cl. ..... 118/712; 118/629; 118/642; 118/671

(58) Field of Classification Search ..... 118/620–643, 118/663, 667, 712, 713, 671; 427/483, 421, 427/479, 475, 485; 435/285.2, 285.3, 458, 435/459, 470, 471; 239/690, 695, 696, 706
See application file for complete search history.

(56) References Cited

U.S. PATENT DOCUMENTS 5,948,483 A * 9/1999 Kim et al. ..... 427/483
2007/0157880 A1 7/2007 Tanioka et al.

FOREIGN PATENT DOCUMENTS

WO 2004/074172 9/2004

* cited by examiner

*Primary Examiner* — Yewebdar Tadesse
(74) *Attorney, Agent, or Firm* — Drinker Biddle & Reath LLP

(57) ABSTRACT

In an immobilization process of electrostatically spraying a nanomaterial dispersion liquid 13 from an electrostatic spray nozzle 20 and immobilizing a nanomaterial on a sample 10, a voltage is applied between the dispersion liquid 13 and the sample 10 to electrostatically spray the dispersion liquid 13 onto the sample 10 from a spray outlet 22 of the nozzle 20 under a condition where one or zero particles of the nanomaterial 18 are contained in each individual droplet 16 sprayed and electrostatically deposit the nanomaterial 18 onto a surface of the sample 10 after drying a solvent 17, contained in each individual droplet 16, in an atmosphere to immobilize the nanomaterial 18 on the sample 10. Aggregation of the nanomaterial in each droplet is thereby prevented and the nanomaterial can be immobilized favorably on the sample.

5 Claims, 15 Drawing Sheets

(a)

(b)

(a)

(b)

(a)

(b)

(a)

(b)

(a)

(b)

(a)

(b)

NANOMATERIAL IMMOBILIZATION METHOD AND IMMOBILIZATION APPARATUS

BACKGROUND OF THE INVENTION

1. Field of the Invention

The present invention relates to a nanomaterial immobilization method and a nanomaterial immobilization apparatus for immobilizing a nanomaterial on a sample by electrostatically spraying a dispersion liquid in which the nanomaterial is dispersed in a solvent.

2. Related Background of the Invention

With recent advances in nanotechnology, a wide variety of nanomaterials have been created. Because new characteristics not seen in normal, bulk body materials are expressed in nanomaterials due to effects of their ultramicroscopic size, etc., nanomaterials are anticipated for utilization in various fields and applications.

Unlike bulk materials, the above-described nanomaterials are difficult to handle due to being extremely small and have a property that a plurality of nanomaterials aggregate readily to form aggregates. Thus, in many cases, nanomaterials are handled in a state of a nanomaterial dispersion liquid, in which a nanomaterial is dispersed in a solvent. As an example of a method for using such a nanomaterial, there is a method for immobilizing a nanomaterial on a surface of a bulk material of substrate form or other predetermined shape to add and make a useful function of the nanomaterial be expressed (see, for example, Patent Document 1).

Patent Document 1: International Publication No. WO2004/074172

SUMMARY OF THE INVENTION

As a method for immobilizing a nanomaterial on a bulk body sample, there is a method for coating a nanomaterial dispersion liquid, in which the nanomaterial is dispersed, onto a sample surface. However, with this method, the nanomaterial aggregates in a process of drying a solvent after coating of the nanomaterial dispersion liquid, and consequently, inherent characteristics of the nanomaterial cannot be expressed adequately.

As another method for immobilizing a nanomaterial on a sample, an electrostatic spray method for spraying a nanomaterial dispersion liquid onto the sample may be considered (Patent Document 1). With the electrostatic spray method, a high voltage is applied to a capillary-like nozzle filled with the nanomaterial dispersion liquid and charged droplets of the dispersion liquid are sprayed toward the sample from a dispersion liquid spray outlet at a nozzle tip to immobilize the nanomaterial on a sample surface. However, even with such a method, there is a problem that all of the nanomaterial inside a sprayed droplet forms an aggregate in a process of drying of a solvent of the droplet.

The present invention has been made to solve the above problem, and an object thereof is to provide a nanomaterial immobilization method and a nanomaterial immobilization apparatus enabling a nanomaterial to be immobilized favorably on a sample by suppressing aggregation of the nanomaterial.

To achieve the above object, a nanomaterial immobilization method according to the present invention is an immobilization method for immobilizing a nanomaterial on a sample and includes: (1) a dispersion liquid introducing step of using an electrostatic spray nozzle, including a nozzle body, having a tubular structure capable of storing, in an interior thereof, a nanomaterial dispersion liquid, in which a nanomaterial is dispersed in a solvent, and having a dispersion liquid spray outlet, provided at a tip of the tubular structure, for electrostatically spraying the nanomaterial dispersion liquid, and introducing the nanomaterial dispersion liquid into the interior of the nozzle body; (2) a sample setting step of setting a sample, which is a target of nanomaterial immobilization, so as to oppose the dispersion liquid spray outlet of the electrostatic spray nozzle; (3) a spraying step of applying a voltage between the nanomaterial dispersion liquid and the sample and electrostatically spraying the nanomaterial dispersion liquid onto the sample from the dispersion liquid spray outlet of the electrostatic spray nozzle under a condition where one or zero particles of the nanomaterial are contained in each individual droplet sprayed; (4) a drying step of subjecting each individual droplet of the nanomaterial dispersion liquid sprayed from the electrostatic spray nozzle to drying of the solvent contained in the droplet in a spray atmosphere; and (5) an immobilizing step of immobilizing the nanomaterial on the sample by electrostatically depositing the nanomaterial, in the state in which the solvent of the nanomaterial dispersion liquid has been dried, onto a surface of the sample.

A nanomaterial immobilization apparatus according to the present invention is an immobilization apparatus that immobilizes a nanomaterial on a sample and includes: (a) an electrostatic spray nozzle, including a nozzle body, having a tubular structure capable of storing, in an interior thereof, a nanomaterial dispersion liquid, in which a nanomaterial is dispersed in a solvent, and having a dispersion liquid spray outlet, provided at a tip of the tubular structure, for electrostatically spraying the nanomaterial dispersion liquid; (b) a sample support, supporting the sample, which is a target of nanomaterial immobilization so as to oppose the dispersion liquid spray outlet of the electrostatic spray nozzle; and (c) a voltage applying unit, applying an electrostatic spraying voltage between the nanomaterial dispersion liquid and the sample; and in the apparatus, (d) in electrostatically spraying the nanomaterial dispersion liquid from the dispersion liquid spray outlet of the electrostatic spray nozzle to the sample, the voltage applying unit applies the voltage so as to achieve a condition where one or zero particles of the nanomaterial are contained in each individual droplet sprayed, and (e) the electrostatic spray nozzle and the sample support are disposed so that with each individual droplet of the nanomaterial dispersion liquid sprayed from the electrostatic spray nozzle, the solvent contained in the droplet is dried in a spray atmosphere and the nanomaterial is electrostatically deposited on a surface of the sample in a state where the solvent of the nanomaterial dispersion liquid has dried to immobilize the nanomaterial on the sample.

With the above-described nanomaterial immobilization apparatus and immobilization method, the nanomaterial is immobilized on the sample by applying a predetermined voltage between the nanomaterial dispersion liquid, filled in the interior of the electrostatic spray nozzle, and the sample, electrostatically spraying and drying the dispersion liquid, and electrostatically depositing the nanomaterial. With such a configuration, aggregation of the nanomaterial on the sample can be suppressed in comparison to a method for coating the nanomaterial dispersion liquid onto the sample surface, etc.

Furthermore, in regard to the electrostatic spraying of the dispersion liquid from the electrostatic spray nozzle to the sample in the immobilization of the nanomaterial, the spraying of the dispersion liquid is performed under the condition where one or zero particles of the nanomaterial are contained in each individual droplet. By thus performing electrostatic spraying of the dispersion liquid so that at most one particle of the nanomaterial is contained in each individual droplet sprayed, the nanomaterial contained in the droplet is prevented from forming an aggregate in the process of drying of the solvent, and the nanomaterial can thus be immobilized favorably in an adequately dispersed state on the sample. Here, as the nanomaterial, a material with a size not more than 100 nm (for example, nanoparticles with a diameter not more than 100 nm) is preferably used.

With the above-described nanomaterial immobilization method and immobilization apparatus, by applying the voltage between the nanomaterial dispersion liquid, filled in the interior of the nozzle, and the sample to electrostatically spray and dry the dispersion liquid and electrostatically deposit the nanomaterial to immobilize the nanomaterial on the sample and by performing the spraying under the condition where one or zero particles of the nanomaterial are contained in each individual droplet in the electrostatic spraying of the dispersion liquid, aggregation of the nanomaterial in each droplet is prevented and the nanomaterial can be immobilized favorably on the sample.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

Figure 1:
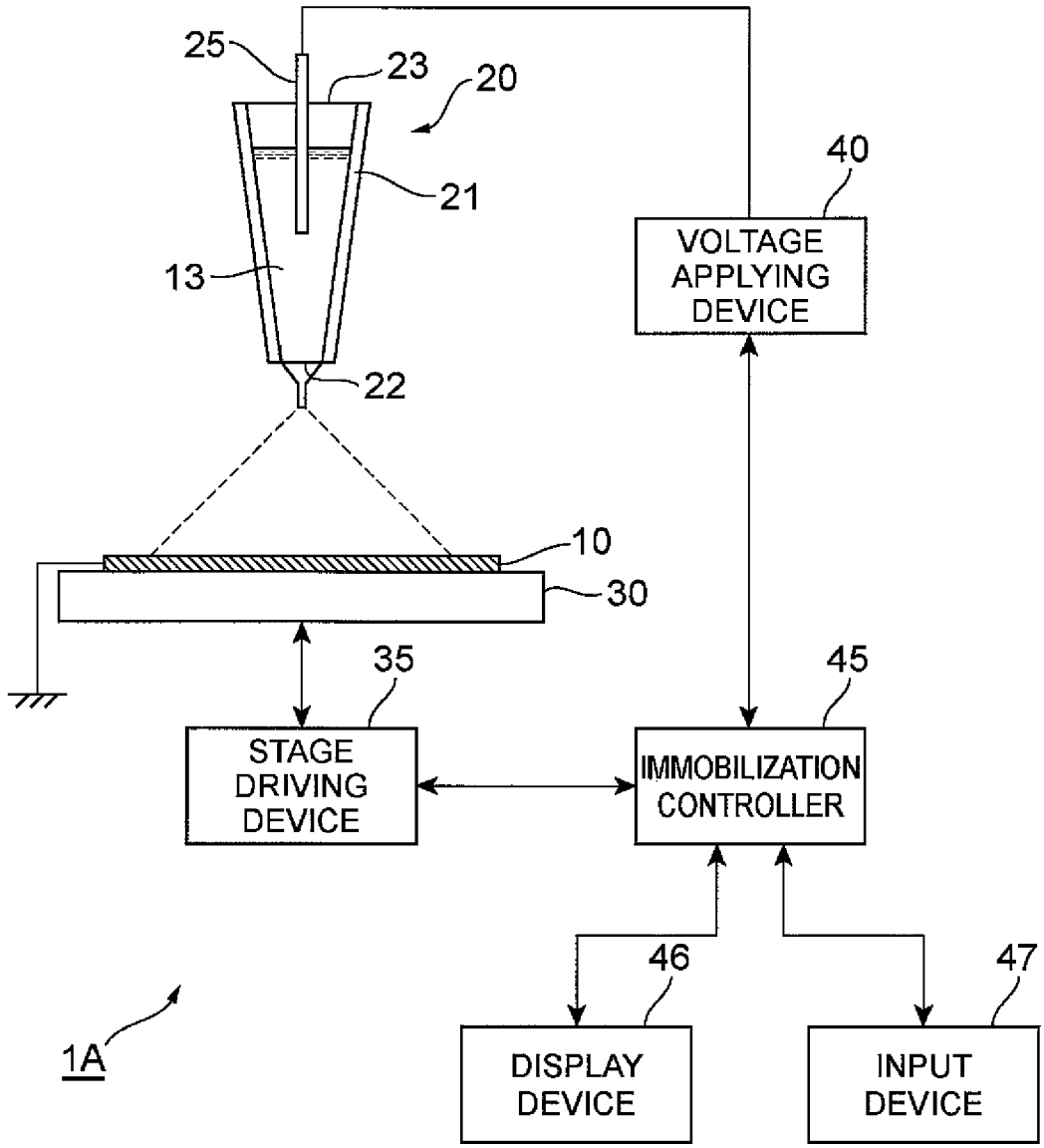
FIG. 1 is a block diagram of a configuration of a first embodiment of a nanomaterial immobilization apparatus.

Preferred embodiments of a nanomaterial immobilization method and a nanomaterial immobilization apparatus according to the present invention shall now be described in detail along with the drawings. In the description of the drawings, elements that are the same are provided with the same symbol and redundant description shall be omitted. Dimensional proportions in the drawings do not necessarily match those of the description.

FIG. 1 is a schematic block diagram of a configuration of a first embodiment of a nanomaterial immobilization apparatus according to the present invention. The nanomaterial immobilization apparatus 1A according to the present embodiment immobilizes a nanomaterial on a surface of a bulk material by using a nanomaterial dispersion liquid, in which the nanomaterial is dispersed in a solvent, and electrostatically spraying the dispersion liquid. In the following description, a sample is a bulk material of substrate form or other predetermined shape that is a target of nanomaterial immobilization. As the nanomaterial subject to the immobilization process, a microscopic material with a size not more than 100 nm (for example, nanoparticles with a diameter not more than 100 nm) is preferably used. Such a microscopic material exhibits physical properties (optical characteristics, electrical characteristics, physical characteristics, etc.) that differ from those of normal, bulk material.

The nanomaterial immobilization apparatus 1A shown in FIG. 1 includes the electrostatic spray nozzle 20, a sample stage 30, on which the sample 10 is placed, a voltage applying device 40, and an immobilization controller 45. In this configuration, a vertical direction in the figure that is directed from the nozzle 20 to the sample 10 on the stage 30 is a nanomaterial spraying axis in the immobilization apparatus 1A. In FIG. 1, the sample 10 of substrate form is disposed in a horizontal direction and the above-described spraying axis extends along a perpendicular direction with respect to a surface of the sample 10.

The electrostatic spray nozzle 20 is for electrostatically spraying the nanomaterial dispersion liquid 13, in which the nanomaterial is dispersed in the solvent, and has a nozzle body 21, having a tubular structure capable of storing the nanomaterial dispersion liquid 13 in its interior. In the present embodiment, the nozzle 20 is installed with a longitudinal axis of the tubular structure of the nozzle body 21 (central axis of the nozzle) being matched to the nanomaterial spraying axis. Of openings 22 and 23 at respective ends of the nozzle body 21, one of the openings, that is, the opening 22 disposed at the lower end in FIG. 1 is configured as a dispersion liquid spray outlet for electrostatically spraying the nanomaterial dispersion liquid 13 onto the sample 10. The nozzle 20 having the nozzle body 21 can be prepared using a glass capillary made of a glass material.

With respect to the electrostatic spray nozzle 20 filled with the nanomaterial dispersion liquid 13, the sample 10, which is the target of nanomaterial immobilization, is set on the sample stage 30, positioned below the nozzle 20, so as to oppose the dispersion liquid spray outlet 22 of the nozzle 20. The sample stage 30 is a sample support that supports the sample 10 in a predetermined state with respect to the electrostatic spray nozzle 20.

In a case where adjustment of a setting position of the sample 10, etc., needs to be performed, an XY stage, movable in X and Y directions (horizontal directions), or an XYZ stage, movable in the X and Y directions (horizontal directions) and a Z direction (vertical direction), may be used as the sample stage 30. In this case, a stage driving device 35 for driving and controlling the stage is provided for the sample stage 30 as shown in FIG. 1. If adjustment of the position of the sample 10 is unnecessary or adjustment of the position of the sample 10 is to be performed by adjustment of a position of the nozzle 20, a fixed stage may be used as the sample stage 30. In this case, the stage driving device 35 is unnecessary.

The sample 10 on the sample stage 30 is connected to a ground potential directly or via an electrode provided on the stage 30, etc. Meanwhile, in the interior of the nozzle body 21 of the electrostatic spray nozzle 20, an electrode 25 is disposed at the opening 23 side at an upper end in a state of being electrically connected to the dispersion liquid 13. The voltage applying device 40 is connected to the electrode 25. By a predetermined voltage being applied from the voltage applying device 40 to the nanomaterial dispersion liquid 13 via the electrode 25, an electrostatic spraying voltage is applied between the dispersion liquid 13 inside the nozzle 20 and the sample 10 at the ground potential.

The immobilization controller 45 is provided for the immobilization apparatus 1 A, including the electrostatic spray nozzle 20, the sample stage 30, the stage driving device 35, and the voltage applying device 40. The controller 45 controls operations of respective portions of the immobilization apparatus 1A to control conditions of immobilization of the nanomaterial onto the sample 10 and control execution of the nanomaterial immobilization process. In particular, the controller 45 has a function of a voltage controller that controls the electrostatic spraying voltage applied to the dispersion liquid 13 by the voltage applying device 40 according to specific nanomaterial immobilization conditions. In regard to voltage application by the voltage applying device 40, a configuration where manual control by an operator is performed is also possible.

With the configuration shown in FIG. 1, a display device 46 and an input device 47 are connected to the immobilization controller 45. The display device 46 is used to display necessary information concerning immobilization process setting conditions, processing circumstances, processing results, etc., to the operator. The input device 47 is used to input information on necessary conditions, instructions, etc., concerning the immobilization process.

The nanomaterial immobilization method according to the present invention that is executed using the immobilization apparatus 1A shown in FIG. 1 shall now be described. In the immobilization method, first, the nanomaterial dispersion liquid, in which the nanomaterial to be immobilized is dispersed in the solvent, is prepared and, for the electrostatic spray nozzle 20, the dispersion liquid 13 is introduced into the interior of the nozzle body 21 (dispersion liquid introducing step). As shall be described later, the introduction of the dispersion liquid 13 is performed from the opening 23 at the upper end of the nozzle body 21 or from the dispersion liquid spray outlet 22, which is the lower end opening, according to a specific configuration, etc., of the immobilization apparatus 1A.

The bulk-form sample 10, which, with respect to the nanomaterial dispersion liquid 13, is the target of nanomaterial immobilization, is prepared. As the sample 10, for example, a substrate, made of a predetermined material for immobilization of the nanomaterial on its surface, is used. The sample 10 is set on the sample stage 30 so as to oppose the dispersion liquid spray outlet 22 of the nozzle 20 (sample setting step). Here, in regard to setting the sample 10, the sample 10 may be set in advance before introduction of the dispersion liquid 13 into the nozzle 20.

Next, the voltage applying device 40 is driven and controlled by the controller 45 to apply the electrostatic spraying voltage to the nanomaterial dispersion liquid 13 inside the nozzle 20 with respect to the sample 10 at the ground potential. In this state where the voltage is being applied, the dispersion liquid 13 is electrostatically sprayed onto the sample 10 from the spray outlet 22 of the nozzle 20 (spraying step), and with each individual droplet of the nanomaterial dispersion liquid 13 sprayed from the nozzle 20, the solvent contained in the droplet is dried in a spray atmosphere (drying step), and by electrostatically depositing the nanomaterial contained in the sprayed dispersion liquid 13 onto the surface of the sample 10 in a solvent-dried state, the nanomaterial is immobilized on the sample 10 (immobilizing step).

Figure 2:
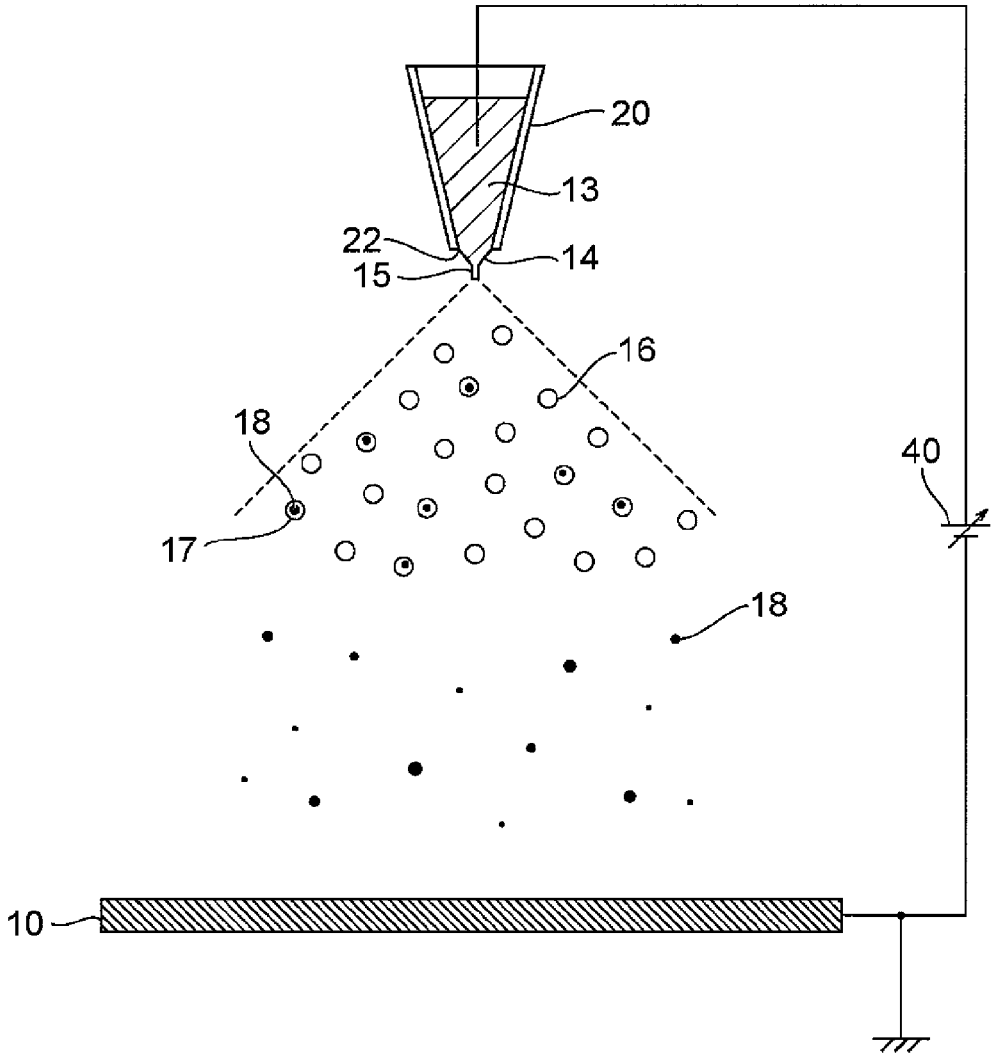
FIG. 2 is a schematic diagram of an embodiment of a nanomaterial immobilization method.

The immobilization conditions in the nanomaterial immobilization shall now be described further. FIG. 2 is a schematic diagram of an embodiment of a nanomaterial immobilization method according to the present invention. As mentioned above, in the dispersion liquid 13 filled in the interior of the nozzle 20, the nanomaterial 18 is in a state of being dispersed in the solvent 17. Also with the example shown in FIG. 2, the sample 10 is connected to the ground potential.

When in this state, the electrostatic spraying voltage (a positive voltage in the example of FIG. 2) is applied to the dispersion liquid 13 inside the nozzle 20, a Taylor cone 14 with a conical liquid surface is formed from the dispersion liquid spray outlet 22 at the tip of the nozzle 20 toward the sample 10 below. From the tip of the Taylor cone 14, the dispersion liquid 13 becomes, via a fine jet 15, a plurality of charged microdroplets 16 (positively charged microscopic droplets in the example of FIG. 2).

The charged droplets 16 of the nanomaterial dispersion liquid 13 are thereby electrostatically sprayed from the nozzle 20 at the positive potential onto the sample 10 at the ground potential (spraying step). Also, as shown in FIG. 2, the electrostatic spraying of the dispersion liquid 13 is performed under a condition where one or zero particles of the nanomaterial 18 are contained in each individual droplet 16 sprayed. In this case, a droplet 16 formed from the tip of the electrostatic spray nozzle 20 is either a droplet containing one particle of the nanomaterial 18 or a droplet of just the solvent 17 that does not contain any of the nanomaterial 18.

With each individual droplet 16 of the dispersion liquid 13 sprayed from the spray outlet 22 of the nozzle 20, the solvent 17 contained in the droplet 16 dries and a state where just the nanomaterial 18 remains is attained in the spray atmosphere until reaching the sample 10 from the nozzle 20 (drying step). The positively charged nanomaterial 18 in the state where the solvent 17 has dried up is then electrostatically deposited on the surface of the sample 10, and the nanomaterial particles 18 are thereby dispersed and immobilized in a scattered state on the sample 10 (immobilizing step).

Effects of the nanomaterial immobilization method and the nanomaterial immobilization apparatus according to the above-described embodiment shall now be described.

With the nanomaterial immobilization apparatus 1A and the immobilization method shown in FIGS. 1 and 2, the nanomaterial is immobilized on the sample 10 by applying the predetermined voltage between the nanomaterial dispersion liquid 13, filled in the interior of the electrostatic spray nozzle 20, and the sample 10 to electrostatically spray and dry the dispersion liquid 13 and electrostatically deposit the nanomaterial 18. With this configuration, aggregation of the nanomaterial 18 on the sample 10 can be suppressed in comparison to a method for coating the dispersion liquid 13 on the sample surface, etc.

Furthermore, in regard to the electrostatic spraying of the dispersion liquid 13 from the nozzle 20 onto the sample 10 in the immobilization of the nanomaterial, the spraying of the dispersion liquid 13 is performed under the condition where one or zero particles of the nanomaterial 18 are contained in each individual droplet 16. By thus performing electrostatic spraying of the dispersion liquid 13 so that at most one particle of the nanomaterial is contained in each individual droplet sprayed, the nanomaterial 18 contained in the droplet 16 is prevented from forming an aggregate in the process of drying of the solvent 17, and the nanomaterial 18 can thus be immobilized favorably in an adequately dispersed state on the sample 10.

Also, in the above-described immobilization method, with each individual droplet 16 of the dispersion liquid 13 sprayed from the nozzle 20, the solvent 17 contained in the droplet 16 is dried in the spray atmosphere at a stage before deposition on the sample 10, and the nanomaterial 18 is electrostatically deposited on the surface of the sample 10 in a solvent-dried state to immobilize the nanomaterial on the sample 10. The nanomaterial contained in each individual droplet sprayed from the nozzle 20 can thereby be immobilized favorably on the surface of the sample 10.

Such spraying conditions, drying conditions, and immobilization conditions in nanomaterial immobilization can be realized by appropriately setting and adjusting such conditions as the configuration, shape, and size of the electrostatic spray nozzle 20, the nanomaterial concentration in the dispersion liquid 13, the distance between the nozzle 20 and the sample 10, the value of the electrostatic spraying voltage applied to the dispersion liquid 13, a diameter of each droplet sprayed from the nozzle 20, etc.

For example, in performing the immobilization process using the immobilization apparatus 1A shown in FIG. 1, it is preferable for the voltage applying device 40 to be configured to apply, in the process of electrostatically spraying the dispersion liquid 13, a voltage with which the condition where one or zero particles of the nanomaterial are contained in each droplet sprayed is achieved. Also, it is preferable that the nozzle 20 and the sample stage 30 be positioned so that, with each individual droplet of the dispersion liquid 13 sprayed, the solvent contained in the droplet dries in the spray atmosphere and the nanomaterial is electrostatically deposited in the solvent-dried state on the surface of the sample 10. In regard to the voltage applying device 40, the application voltage may be controlled by the immobilization controller 45 functioning as a voltage controller to realize the above-described immobilization conditions. Also, if necessary, the positions of the nozzle 20 and the sample stage 30 may likewise be controlled by the controller 45.

Figure 3:
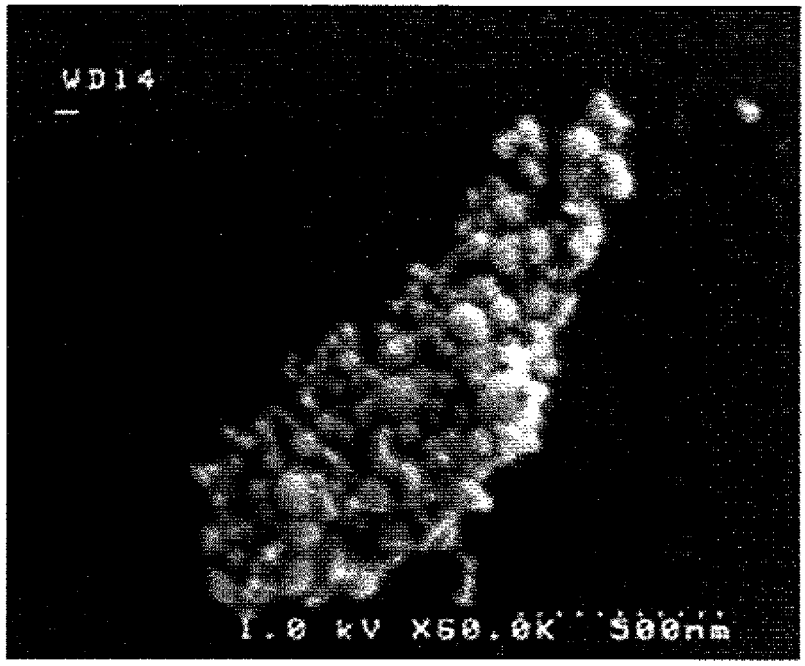
FIG. 3 shows diagrams of examples of immobilization of gold nanoparticles on a sample.
Figure 3:
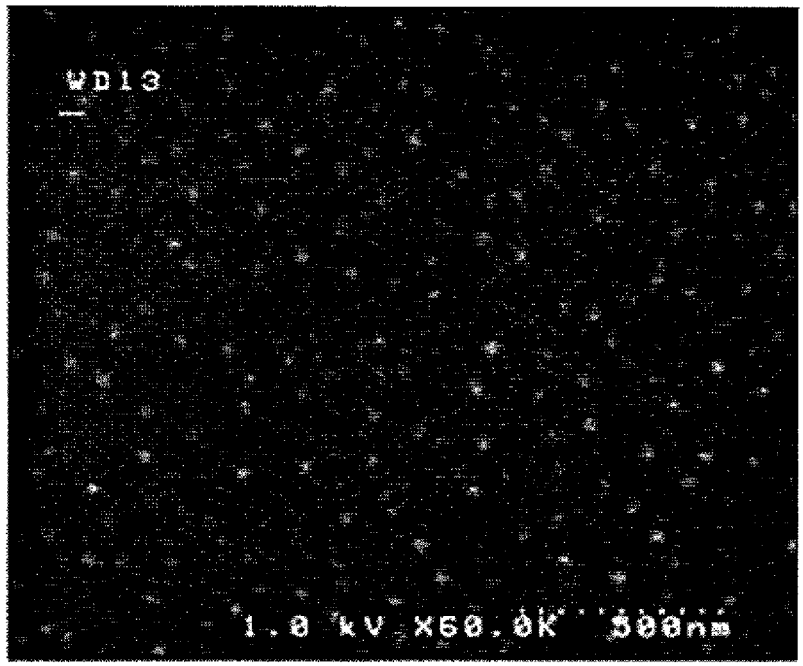
Figure 4:
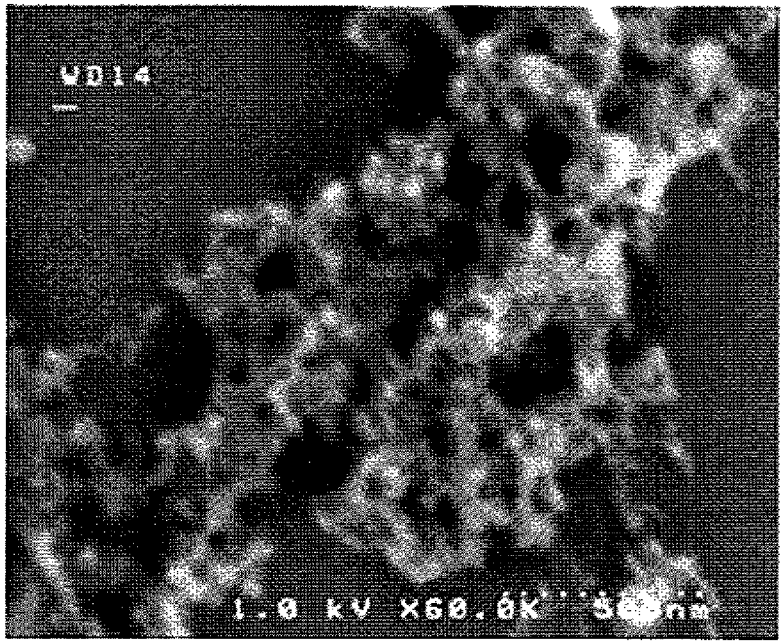
FIG. 4 shows diagrams of examples of immobilization of silver nanoparticles on a sample.
Figure 4:
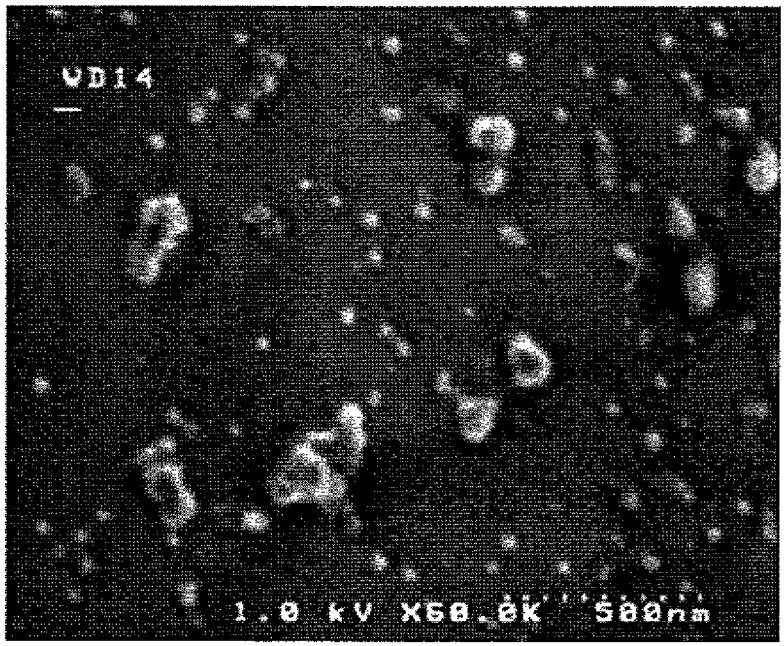

Specific examples of the nanomaterial immobilization process by the above-described nanomaterial immobilization apparatus and immobilization method shall now be described. FIGS. 3 and 4 show diagrams of examples of immobilization of a nanomaterial onto a sample.

FIG. 3 shows diagrams of examples of immobilization of gold nanoparticles on a sample as examples of nanomaterial immobilization, with (a) in FIG. 3 showing an immobilization state in a case where an immobilization process by a method for coating a gold nanoparticle dispersion liquid on a sample is performed, and (b) in FIG. 3 showing an immobilization state in a case where a gold nanoparticle immobilization process by electrostatic spraying by the immobilization apparatus according to the present invention is performed. As shown in FIG. 3, whereas with the method for coating the dispersion liquid, the gold nanoparticles are immobilized in an aggregated state, with the immobilization method by electrostatic spraying, the gold nanoparticles are immobilized in a dispersed state without aggregating.

FIG. 4 shows diagrams of examples of immobilization of silver nanoparticles on a sample as other examples of nanomaterial immobilization, with (a) in FIG. 4 showing an immobilization state in a case where an immobilization process by a method for coating a silver nanoparticle dispersion liquid on a sample is performed, and (b) in FIG. 4 showing an immobilization state in a case where a silver nanoparticle immobilization process by electrostatic spraying by the immobilization apparatus according to the present invention is performed. As shown in FIG. 4, even with silver nanoparticles, which aggregate more readily than gold nanoparticles, the silver nanoparticles are immobilized in a dispersed state almost without aggregating by use of the immobilization method by electrostatic spraying.

Figure 5:
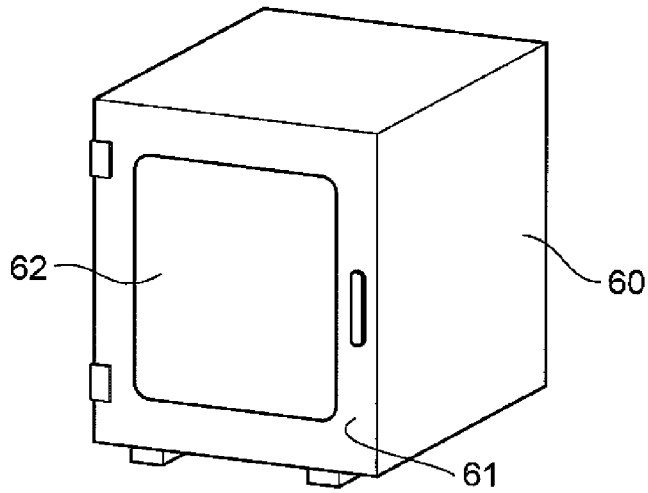
FIG. 5 shows diagrams of a configuration for housing a nozzle and a sample stage in a spray chamber.
Figure 5:
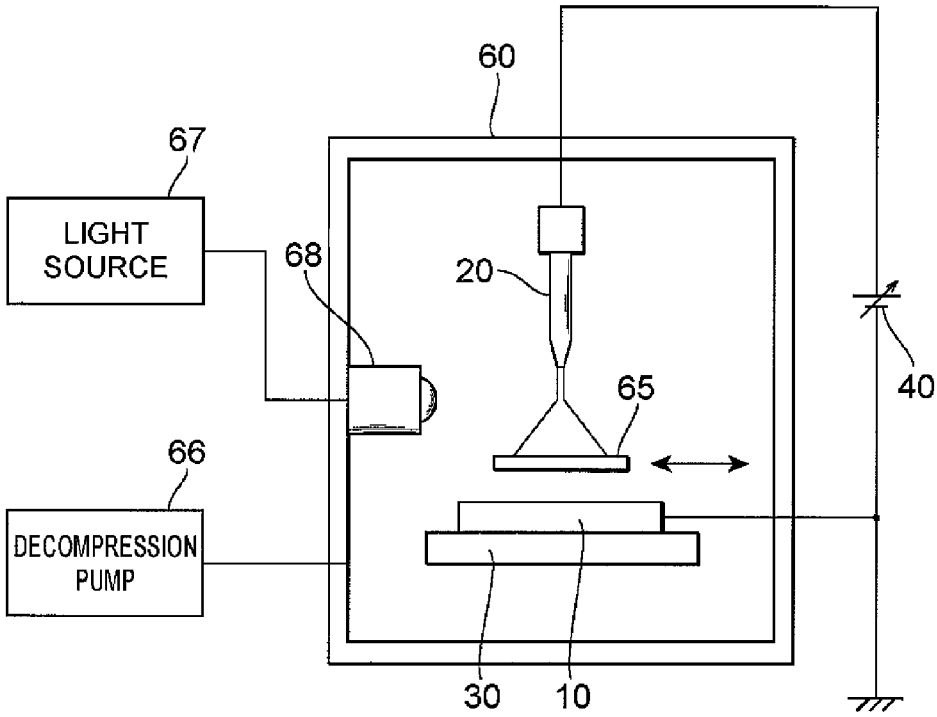

If, in regard to the spraying of the dispersion liquid 13 from the electrostatic spray nozzle 20 to the sample 10, the spray atmosphere must be adjusted and controlled, a spray chamber 60, housing the nozzle 20, the sample stage 30, etc., may be configured as shown schematically in (a) in FIG. 5 and (b) in FIG. 5. In this case, a type of gas to be the atmosphere in performing the nanomaterial immobilization process inside the spray chamber 60 or a pressure of the gas, etc., can be set appropriately. FIG. 5(*b*) shows, as a specific configuration example, a configuration in which a decompression pump 66 is connected to the spray chamber 60.

With the configuration shown in FIG. 5(*a*), an observation window 62 is provided on a door 61 of a front face of the spray chamber 60, and the observation window 62 is made up of a Fresnel lens or other magnifying lens. With this configuration, the nanomaterial immobilization process executed in the interior of the spray chamber 60 can be observed and checked readily. With the configuration shown in FIG. 5(*b*), an illumination 68, using a cold light source 67, is disposed in the interior of the spray chamber 60 for observation, etc., of the immobilization process. Also, a spray shutter 65 that switches between execution and non-execution of electrostatic spraying may be disposed inside the spray chamber 60 and between the nozzle 20 and the sample 10.

Here, a method for immobilizing a substance to be immobilized in a solution onto a target by electrostatic spraying by applying a voltage to a solution inside a capillary is described in Patent Document 1 (International Publication No. WO2004/074172). However with the configuration of Document 1, there is the problem that the plurality of particles of the nanomaterial contained in the sprayed droplet aggregate as mentioned above. On the other hand, with the nanomaterial immobilization method and immobilization apparatus according to the present invention, spraying of the dispersion liquid is performed under the condition where one or zero particles of the nanomaterial are contained in each individual droplet. With this configuration, aggregation of the nanomaterial in the droplet is prevented and the nanomaterial can be immobilized in an adequately dispersed state on the sample.

The configuration of the electrostatic spray nozzle 20 used for spraying of the dispersion liquid in the immobilization apparatus 1A shown in FIG. 1 shall now be described. As the nozzle 20, the configuration having the tubular nozzle body 21 employing a glass capillary, etc., as described above can be used favorably. In regard to the nozzle body 21 of nozzle 20, an inner diameter at a tip of the tubular structure is preferably not more than 50 μm.

By thus making the inner diameter of the nozzle body 21 and the nozzle bore diameter at the spray outlet 22 adequately small, it becomes possible to make microdroplets of the dispersion liquid 13 sprayed from the nozzle 20 adequately small, that is, for example, to form microdroplets of submicron order favorable for electrostatic spraying of a nanomaterial having a diameter not more than 100 nm and reliably suppress aggregation of the nanomaterial in the droplets. In particular, by using a narrow diameter nozzle 20 of adequately narrow nozzle bore diameter in the immobilization method described above, the above-described immobilization condition where just one or zero particles of the nanomaterial are contained in each individual droplet can be realized favorably in the electrostatic spraying of the dispersion liquid 13.

In regard to the inner diameter at the tip of the nozzle body 21, it is more preferable to make the inner diameter not more than 20 μm. In consideration of nozzle preparation techniques (for example, glass processing techniques) for preparing the electrostatic spray nozzle 20, the inner diameter at the tip of the nozzle body 21 is preferably not less than 3 μm.

Figure 6:
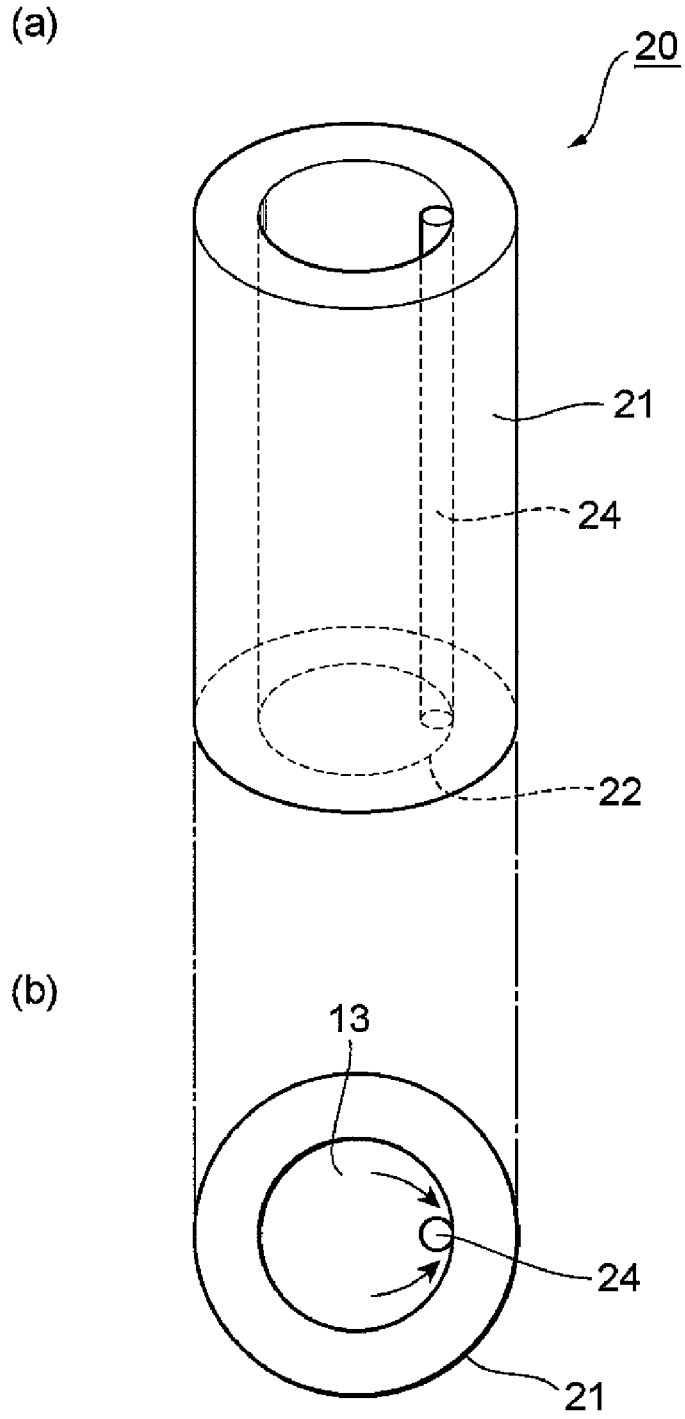
FIG. 6 shows enlarged views of a configuration of a tip of a modification example of an electrostatic spray nozzle.

As another example of a configuration of the nozzle 20, a configuration where a core structure is disposed in an interior of the tubular nozzle body may be employed. FIG. 6 shows enlarged views of a configuration of a tip (a lower end in FIG. 1) of a modification example of the electrostatic spray nozzle 20, with (a) in FIG. 6 being a perspective view of the tip of the nozzle 20 as viewed from a side surface side, and (b) in FIG. 6 being a sectional view of the nozzle 20. In the present modification example, a rod-like core structure 24 is disposed in the interior of the nozzle body 21, and the nozzle 20 is made up of the nozzle body 21 and the core structure 24. As shown in FIG. 6, the core structure 24 is disposed so as to extend along the direction of the longitudinal axis of the nozzle body 21 in a state of contacting an inner wall of the nozzle body 21. Such a core structure 24 is fixed, for example, by fusion bonding to the inner wall of the nozzle body 2 1.

With the configuration where the core structure 24 is disposed in the interior of the nozzle body 21, the dispersion liquid 13 tends to enter into the gap between the inner wall of the nozzle body 21 and the core structure 24 by a capillary action as indicated by arrows in FIG. 6(*b*). Consequently, in the interior of the nozzle body 21, the dispersion liquid 13 is supplied reliably to a tip of the nozzle body 21. In order to adequately supply the dispersion liquid 13 to the spray outlet 22, the core structure 24 is preferably disposed to extend in a predetermined range extending along the longitudinal direction of the nozzle body 21 and including the spray outlet 22 (for example, to extend across an entire length of the nozzle body 21). The nozzle 20 including the nozzle body 21 and the core structure 24 can be prepared using, for example, a glass capillary and a glass rod.

With the nozzle 20 having the core structure 24, even when the tip of the nozzle body 21 is made narrow in diameter, the dispersion liquid 13 is reliably supplied to the tip where the spray outlet 22 is disposed by the capillary action between the inner wall of the nozzle body 21 and the core structure 24. Occurrence of nozzle clogging due to solids or air bubbles, etc., in the interior of the nozzle body 21 is thereby prevented. Also, the immobilization process can be executed efficiently without having to lower the nanomaterial concentration in the dispersion liquid 13.

That is, when the bore diameter of the electrostatic spray nozzle 20 is made small, it becomes difficult to maintain a liquid surface of the dispersion liquid 13 at the spray outlet 22 due to drying of the solvent at the tip of the nozzle 20, etc. Also, nozzle clogging due to solids or air bubbles, etc., may occur. Meanwhile, with the configuration provided with the core structure 24, even when drying of the solvent occurs at the tip of the nozzle 20, the liquid surface of the dispersion liquid 13 is maintained by natural supplying of the solvent to the tip along the core structure 24.

By the drying of the solvent at the tip of the nozzle 20 thus being suppressed, formation of solids that cause nozzle clogging is prevented. Also, even when an air bubble is generated in the interior of the nozzle body 21, because the solvent is naturally supplied to the tip of the nozzle 20 by flowing along the core structure 24 and around the air bubble, occurrence of nozzle clogging due to the air bubble is prevented.

Also, in regard to the electrostatic spraying of the dispersion liquid 13, by the application of the voltage between the dispersion liquid 13 and the sample 10 as shown in FIG. 2, the liquid surface of the Taylor cone 14 is formed below the spray outlet 22, the jet 15 is emitted from a tip of the cone, and the dispersion liquid 13 is sprayed by the formation of the plurality of charged microdroplets 16 in a final stage. In this process, sizes of the jet 15 and the droplet 16 are influenced by an electrostatic force directed toward the sample 10 and a surface tension directed toward the nozzle 20.

Meanwhile, with the nozzle 20 having the core structure 24, in addition to the electrostatic force directed toward the sample 10 and the surface tension directed toward the nozzle 20, a capillary force due to the core structure 24 acts on the Taylor cone 14 as a force tending to pull the liquid surface of the dispersion liquid 13 back toward the tip of the nozzle 20 in a manner similar to the surface tension. The dispersion liquid 13 is thus influenced by the electrostatic force, the surface tension, and the capillary force, and the sizes of the jet 15 and the droplet 16 can be made small in comparison to the case where the core structure 24 is not provided.

The core structure 24 preferably has a diameter in a range of 0.1 times to 0.2 times the inner diameter of the nozzle body 21. In this case, the flow path for the dispersion liquid 13 inside the nozzle body 21 can be combined favorably with the core structure 24 and the dispersion liquid 13 can be supplied favorably by the capillary action to the spray outlet 22 at the tip of the nozzle body 21. For example, in a case where the inner diameter of the nozzle body 21 is 20 μm, the diameter of the core structure 24 is preferably set in a range of 2 μm to 4 μm.

Figure 7:
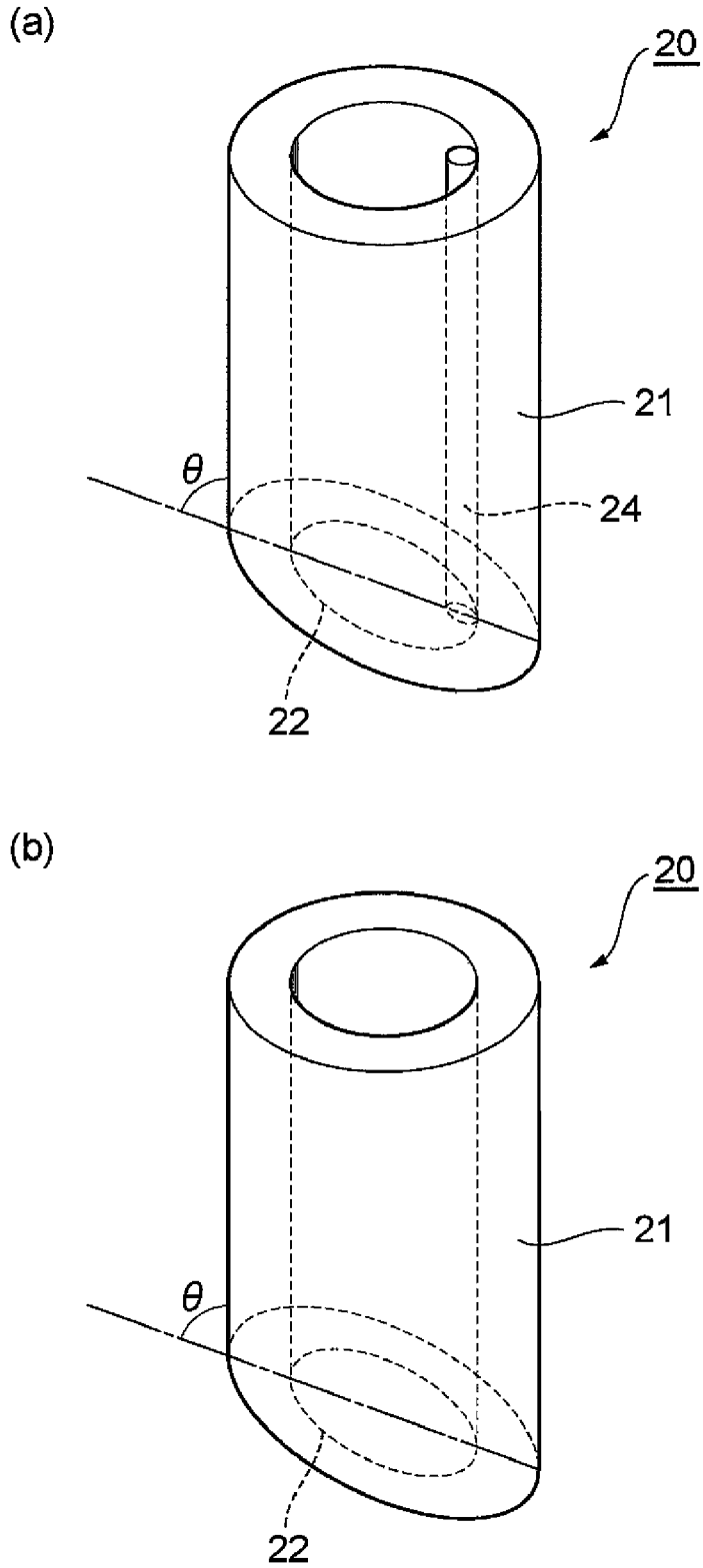
FIG. 7 shows views of a configuration of a tip of another modification example of an electrostatic spray nozzle.
Figure 8:
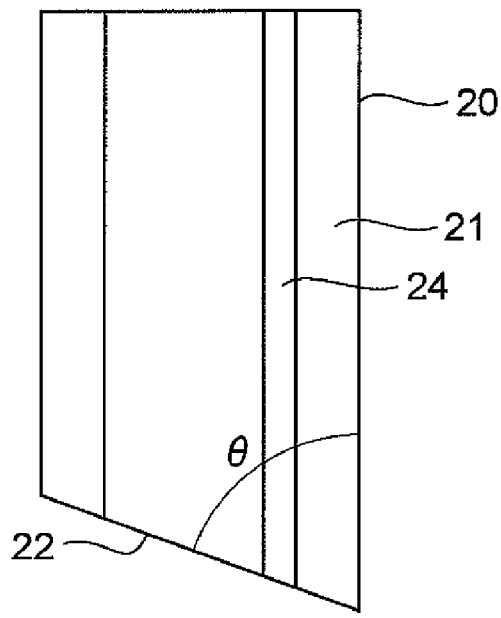
FIG. 8 shows views of a configuration of a tip of another modification example of an electrostatic spray nozzle.
Figure 8:
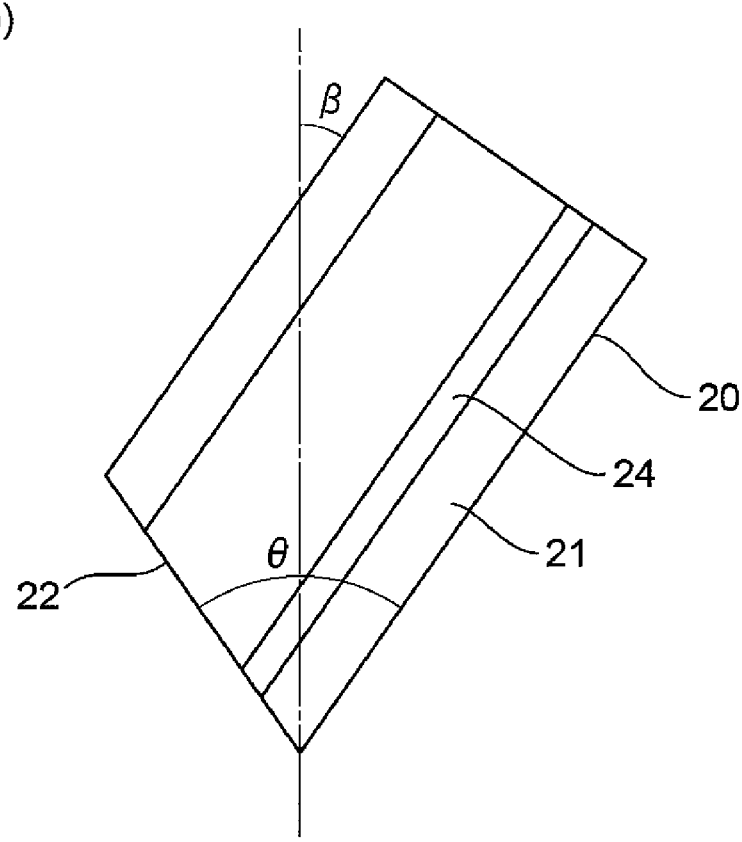

In regard to the specific configuration of the electrostatic spray nozzle 20, although in the above-described configuration example, a tip surface of the nozzle body 21 forming the spray outlet 22 is a surface perpendicular to the longitudinal axis, the nozzle body 21 may, as in another modification example of the configuration of the tip of nozzle 20 shown in a perspective view in (a) in FIG. 7 and a sectional view in (a) in FIG. 8, have an acute angle shape where the spray outlet 22 is inclined at a predetermined angle θ so as to form an acute angle with respect to the longitudinal axis of the tubular structure.

When the nozzle body 21 has such an acute angle shape, a flow path narrower than the inner diameter of the nozzle body 21 is formed at the tip portion and a high electric field for electrostatic spraying concentrates at the tip portion. The droplets of the dispersion liquid 13 formed in the spraying process can thereby be made even smaller. In regard to the angle θ, which the spray outlet 22 forms with respect to the longitudinal axis of the nozzle body 21 (the angle formed by a side surface and the tip surface of the nozzle body 21, see FIG. 8(*a*)) in such an acute angle shape, the inclination angle 0 is preferably set in a range of 45° to 70°.

Also, in the above configuration, the core structure 24 in the interior of the nozzle body 21 is preferably positioned at the tip side of the acute angle at the spray outlet 22 and disposed so as to extend upward from the tip of the acute angle shape as shown in FIG. 7(*a*). The dispersion liquid 13 can thereby be reliably supplied to the tip of the acute angle shape that is the tip of the flow path of the dispersion liquid 13 in the interior of the nozzle body 21. However, in regard to the core structure 24, any of various specific configurations may be employed, such as disposing the core structure 24 at a position shifted by just a predetermined distance from the tip of the acute angle of the nozzle body 21, etc.

Also, in the case where the nozzle body 21 has the acute angle shape, as shown in (b) in FIG. 8, electrostatic spraying of the dispersion liquid 13 onto the sample 10 may be performed with the nozzle 20 being installed so that the longitudinal axis of the nozzle body 21 is in a state of being inclined at an installation angle β toward the tip side of the acute angle shape with respect to the nanomaterial spraying axis. With this configuration, even if an opening area of the elliptical spray outlet 22 of the nozzle body 21 is large, an area of the spray outlet 22 as viewed from the sample 10 can be made small to reliably make small the dispersion liquid microdroplets formed during spraying.

In this case, in regard to the installation angle β of the nozzle 20, the installation angle β is set in a range of preferably θ/4 to 3θ/4 with respect to the angle θ of the acute angle shape of the nozzle body 21, and especially, the installation angle is preferably set so that ⊖=θ/2. In a case where increase of the opening area of the spray outlet 22 of the nozzle body 21, etc., does not present a problem, β may be set to 0° so that the nanomaterial spraying axis and the longitudinal axis of the nozzle body 21 are matched as shown in FIG. 8(*a*).

The configuration where the nozzle body 21 has the acute angle shape can also be applied in a likewise manner to the nozzle 20 that is not provided with the core structure 24 (see FIG. 1) as shown in (b) in FIG. 7. Even in this configuration, the droplets of the dispersion liquid 13 formed during spraying can be made even smaller by the effect of the acute angle shape. The configuration of incliningly positioning the nozzle body 21 with respect to the nanomaterial spraying axis can likewise be applied to the nozzle 20 that is not provided with the core structure 24.

Figure 9:
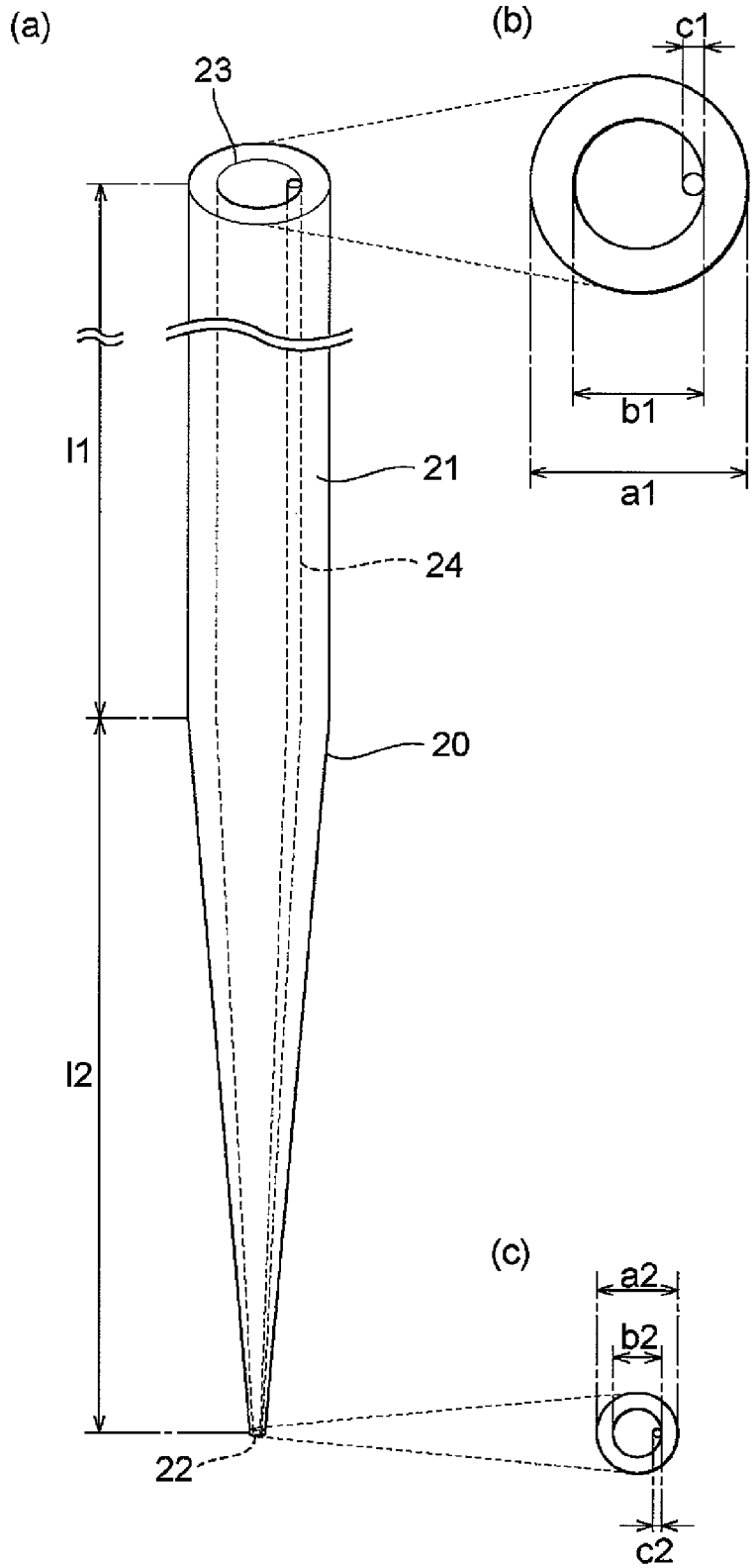
FIG. 9 shows diagrams of a specific example of a configuration of an electrostatic spray nozzle.

FIG. 9 shows diagrams of a specific example of the configuration of the electrostatic spray nozzle 20. The nozzle 20 according to the present configuration example is formed using a tubular glass capillary as the nozzle body 21, using a glass rod, disposed in a state of contacting the inner wall in the interior of the glass capillary, as the core structure 24, and making one end narrow in diameter by glass processing. Of the openings 22 and 23 at the respective ends of the tubular nozzle body 21, the opening 22 at the narrowed end side is the dispersion liquid spray outlet.

In the nozzle 20 shown in (a) in FIG. 9, an opening 23 side portion at the upper end is a wide diameter portion having a fixed diameter. A dispersion liquid spray outlet 22 side portion at the lower end is a narrow diameter portion that decreases in diameter toward the tip. The shape of the upper, wide diameter portion (see (b) in FIG. 9) is specifically such that, for example, a length of the wide diameter portion is l1=60 mm, an outer diameter of the nozzle body 21 is a1=1 mm, the inner diameter is b1=0.6 mm, and the diameter of the core structure 24 is c1=0.1 mm.

Meanwhile, the shape of the lower, narrow diameter portion (see (c) in FIG. 9) is specifically such that, for example, a length of the narrow diameter portion is l2=5 mm, and at a lower end of the narrow diameter portion, the outer diameter of the nozzle body 21 is a2=20 μm, the inner diameter is b2=12 μm, and the diameter of the core structure 24 is c2=2 μm. For example, when an aqueous dispersion liquid of titanium oxide with an average particle diameter of 50 nm and a concentration of 0.1% is used as the nanomaterial dispersion liquid 13, the nanomaterial immobilization process can be executed satisfactorily using the nozzle 20 with which the inner diameter of the nozzle at the tip is 12 μm and under the conditions of the distance between the nozzle 20 and the substrate of the sample 10 being 20 mm and the electrostatic spraying voltage applied to the dispersion liquid 13 being 1400V. In general, the distance between the nozzle 20 and the sample 10 is preferably set to a distance in a range of 5 mm to 30 mm. The electrostatic spraying voltage is preferably set to a voltage not more than 5000V.

Introduction of the nanomaterial dispersion liquid 13 into the electrostatic spray nozzle 20 shall now be described. As mentioned above, the introduction of the dispersion liquid 13 into the interior of the tubular nozzle body 21 is performed, according to the specific configuration, etc., of the immobilization apparatus 1A, from the opening 23 at the upper end of the nozzle body 21 or from the dispersion liquid spray outlet 22, which is the opening at the lower end. Particularly, in regard to the introduction of the dispersion liquid 13 into the nozzle 20, it is preferable to introduce the nanomaterial dispersion liquid 13 into the interior not from the opening 23 at the upper side of the nozzle body 21 but from the dispersion liquid spray outlet 22 at the lower side.

By thus configuring so that the nanomaterial dispersion liquid 13, which is to be electrostatically sprayed, is sucked in from the spray outlet 22 side, it becomes possible, in the interior of the nozzle body 21, to reliably supply the dispersion liquid 13 to the tip at which the spray outlet 22 is disposed. Also, the nozzle 20 can be filled with a minute amount of the nanomaterial dispersion liquid 13 in a simple manner.

When, for example, the dispersion liquid 13 is to be supplied from the opening 23 side at the upper side of the nozzle body 21, the dispersion liquid 13 must be introduced until a certain amount of the dispersion liquid drips from the spray outlet 22 to confirm that the dispersion liquid 13 is filled to the spray outlet 22 at the lower side, and there is thus a problem that a portion of the dispersion liquid is wasted. Meanwhile, in a case where the dispersion liquid 13 is sucked in from the spray outlet 22 side as described above, such wasting of the dispersion liquid 13 is eliminated and all of the nanomaterial dispersion liquid 13 filled in the nozzle 20 can be used for electrostatic spraying.

Figure 10:
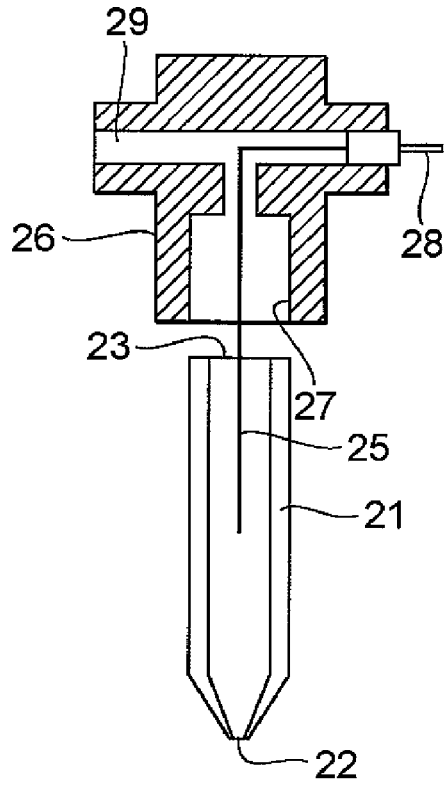
FIG. 10 shows diagrams of a modification example of a configuration of an electrostatic spray nozzle.
Figure 10:
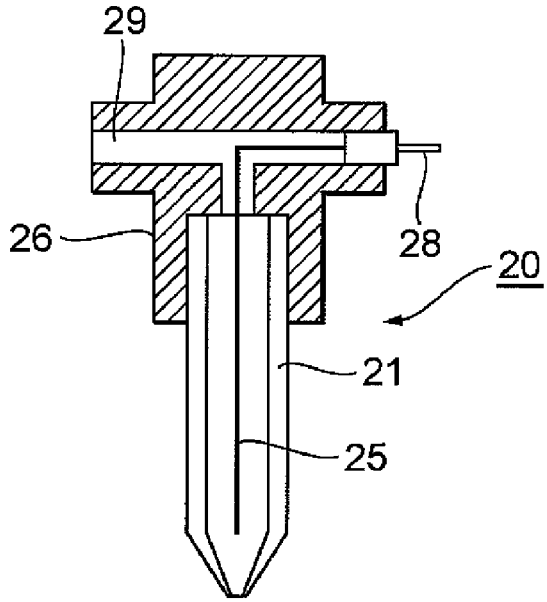

A specific example of a method for introducing the nanomaterial dispersion liquid 13 into the electrostatic spray nozzle 20 and a modification example of the electrostatic spray nozzle 20 shall now be described using FIGS. 10 and 11. FIG. 10 shows diagrams of a modification example of the configuration of the electrostatic spray nozzle. The nozzle 20 according to the present configuration example includes a nozzle holder 26 in addition to the nozzle body 21. Here, (a) in FIG. 10 shows a state before the nozzle body 21 is mounted on the holder 26, and (b) in FIG. 10 shows a state where the electrostatic spray nozzle 20 is assembled by mounting the nozzle body 21 on the holder 26.

As shown in FIG. 10, the nozzle holder 26 is connected to the opening 23 at the opposite side from the dispersion liquid spray outlet 22 of the nozzle body 21 and is configured to support the nozzle body 21. Specifically, the nozzle holder 26 in the nozzle 20 of the present configuration example includes a nozzle body fixing portion 27, a voltage supplying terminal 28, and a negative pressure inlet 29.

The nozzle body fixing portion 27 has a recessed shape at a lower portion of the holder 26, and as shown in FIG. 10(*b*), the nozzle body 21 is fixed to the holder 26 by its upper end being inserted into the fixing portion 27. The nozzle holder 26 is thus enabled to be detachably attached to the nozzle body 21. The voltage supplying terminal 28 is connected to the electrode 25, made from a metal wire, etc., for applying the voltage to the dispersion liquid 13 (see FIG. 1), and the voltage applying device 40 supplies the electrostatic spraying voltage to the electrode 25 and the nanomaterial dispersion liquid 13 via the terminal 28.

The negative pressure inlet 29 is for applying a negative pressure to the interior of the tubular nozzle body 21 and is used in introducing the dispersion liquid 13 into the interior of the nozzle body 21 from the dispersion liquid spray outlet 22 as described above. The negative pressure inlet 29 is spatially connected to the interior of the nozzle body 21 in the state where the nozzle body 21 is fixed to the holder 26. Here, FIG. 11 shows diagrams concerning the introduction of the nanomaterial dispersion liquid 13 into the electrostatic spray nozzle 20.

Figure 11:
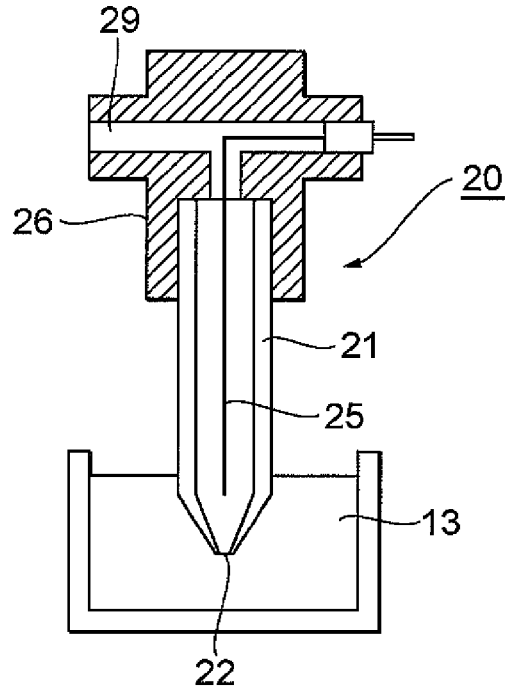
FIG. 11 shows diagrams concerning introduction of a nanomaterial dispersion liquid into an electrostatic spray nozzle.
Figure 11:
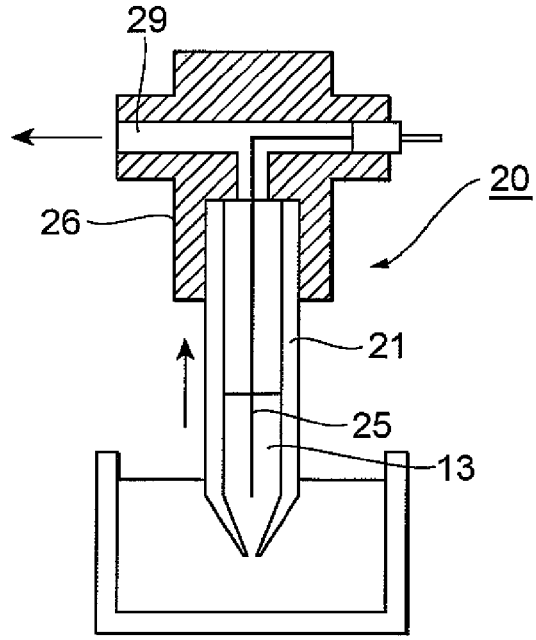

With the method for introducing the dispersion liquid 13, first, as shown in (a) in FIG. 11, the tip of the nozzle body 21, supported by the nozzle holder 26, is immersed in the nanomaterial dispersion liquid 13 contained in a container. Then, as shown in (b) in FIG. 11, by depressurizing the interior of the nozzle body 21 from the negative pressure inlet 29 and putting the interior in a negative pressure state, the liquid level of the dispersion liquid 13 is made to rise from the spray outlet 22 side in the nozzle body 21. A necessary amount of the dispersion liquid 13 is thereby filled into the nozzle 20 from the spray outlet 22 and a state where the dispersion liquid 13 contacts the electrode 25 for voltage application is realized.

With the nozzle 20 of the configuration where the nozzle body 21 is fitted in the holder 26, when the method for introducing the dispersion liquid 13 from the spray outlet 22 side is employed, because the dispersion liquid 13 only fills the interior of the nozzle body 21, a merit that washing of the nozzle holder 26 and other work are made unnecessary is provided. Also, when with the configuration where the dispersion liquid 13 is introduced from the spray outlet 22, the nozzle body 21 has the acute angle shape as shown in FIG. 7, because the opening area of the spray outlet 22 that is a suction inlet for the dispersion liquid 13 is large, a speed of introduction/filling of the dispersion liquid 13 can be made high and a time for introduction/filling can be shortened.

The configuration with which the core structure 24 is disposed in the interior of the nozzle body 21 as described above may also be applied to the case where the dispersion liquid 13 is sucked in from the narrow diameter spray outlet 22. In this case, it becomes possible to suck in the dispersion liquid 13 into the interior of the nozzle body 21 from the spray outlet 22 efficiently due to the capillary action between the inner wall of the nozzle body 21 and the core structure 24.

Figure 12:
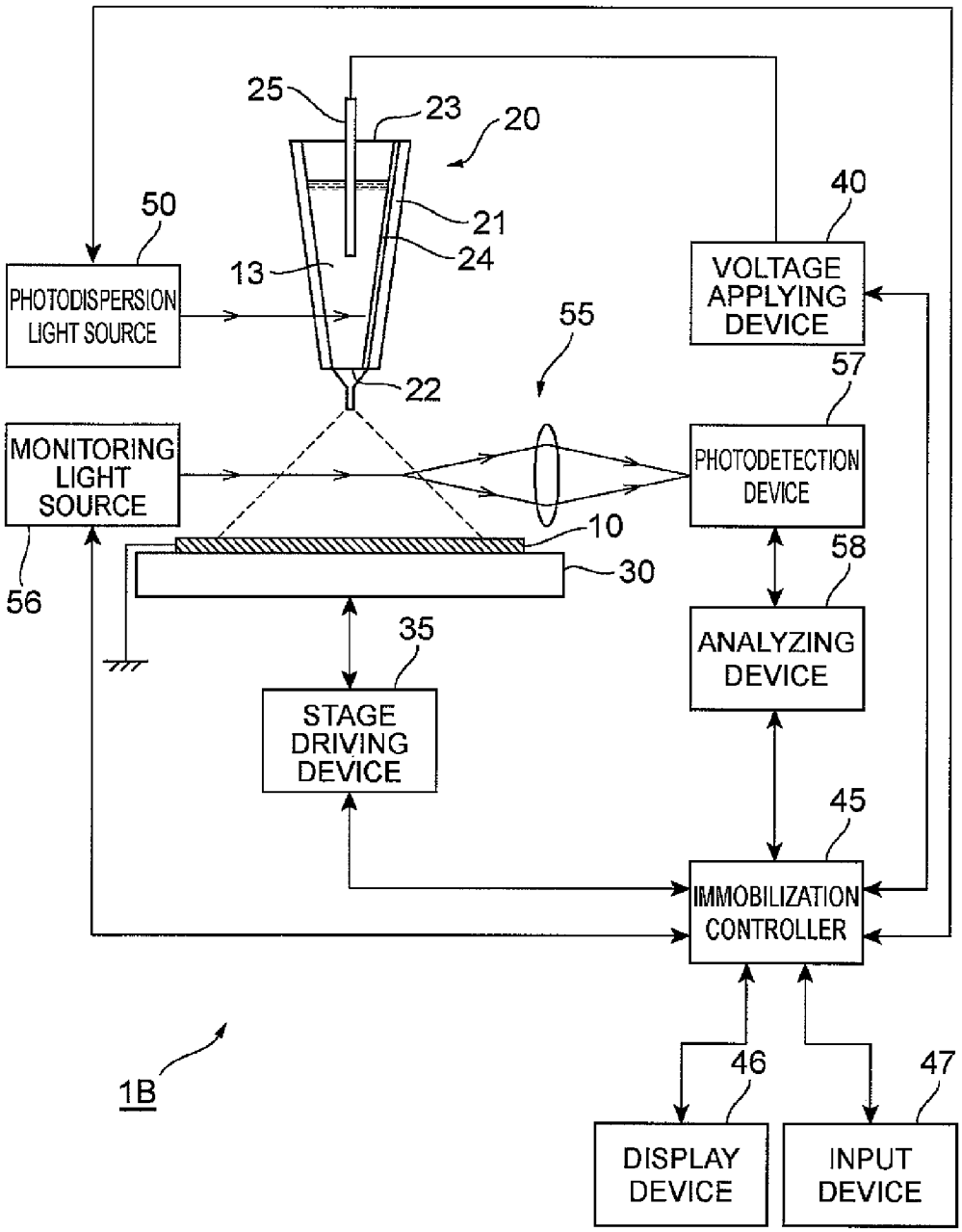
FIG. 12 is a block diagram of a configuration of a second embodiment of a nanomaterial immobilization apparatus.

FIG. 12 is a schematic block diagram of a configuration of a second embodiment of a nanomaterial immobilization apparatus according to the present invention. In regard to the sample stage 30 on which the sample 10 is set, the stage driving device 35, the voltage applying device 40, and the specific immobilization conditions applied to nanomaterial immobilization, the configuration of the nanomaterial immobilization apparatus 1B according to the present embodiment is the same as that of the above-described configuration concerning the immobilization apparatus 1A shown in FIG. 1. Also, with the present embodiment, a configuration including the nozzle body 21 and the core structure 24 is illustrated as the electrostatic spray nozzle 20. However, the nozzle 20 excluding the core structure 24 as in FIG. 1 may be employed in the present configuration as well.

The nanomaterial immobilization apparatus 1B shown in FIG. 12 includes a photodispersion laser light source 50 irradiating the nanomaterial dispersion liquid 13 in the interior of the nozzle body 21, with photodispersion laser light for dispersing aggregated nanomaterial. With this configuration, even if the nanomaterial that is dispersed in the solvent aggregates in the dispersion liquid 13 before electrostatic spraying, the nanomaterial can be redispersed in the solvent of the dispersion liquid 13 by irradiation of the photodispersion laser light (photodispersing step).

The dispersion liquid 13 can thereby be electrostatically sprayed in a state where the nanomaterial is adequately dispersed in the solvent and aggregation of the nanomaterial immobilized on the sample 10 can be suppressed even more reliably. In regard to such a nanomaterial dispersion process by irradiation of laser light, the dispersion process may be performed by irradiating the dispersion liquid 13 prepared in a predetermined container with the laser light in a stage before filling the nozzle 20 with the nanomaterial dispersion liquid 13.

As the laser light used for photodispersion of the nanomaterial in the dispersion liquid 13, for example, pulsed laser light of a wavelength of 350 nm to 1100 nm can be used favorably. Although a laser light intensity in this case differs according to the irradiation wavelength of the laser light or absorbance characteristics, etc., of the nanomaterial dispersion liquid 13 subject to the process, for example with nanosecond-order pulsed laser light, the irradiation intensity is preferably set to 0.01 to 50 $J/cm^2 \cdot$pulse. As a specific photodispersion laser light source 50, for example, a YAG pulsed laser light source (wavelength: 1064 nm, 532 nm, 355 nm) can be used.

Also, with the immobilization apparatus 1B of FIG. 12, an aggregation state monitoring unit 55 is provided for a passage region of the charged nanomaterial, sprayed toward the sample 10 from the electrostatic spray nozzle 20, to optically monitor the aggregation state of the nanomaterial in the passage region. With this configuration, by optically monitoring, in the nanomaterial passage region between the spray outlet 22 of the nozzle 20 and the sample 10, the aggregation state of the nanomaterial, which is sprayed from the electrostatic spray nozzle 20 and with which the solvent is dried in the atmosphere, the aggregation state of the nanomaterial immobilized on the sample 10 can be evaluated in real time during execution of the immobilization process (aggregation state monitoring step).

Specifically, with the configuration example shown in FIG. 12, the aggregation state monitoring unit 55 includes a monitoring light source 56, irradiating the nanomaterial passage region with monitoring light, and a photodetection device 57, detecting at least one of either scattered light or fluorescence generated from the nanomaterial due to the monitoring light. By thus monitoring the aggregation state using the scattered light or the fluorescence generated upon irradiation of the monitoring light on the nanomaterial in the monitoring method that is in accordance with the size of the nanomaterial and other conditions, the aggregation state of the charged nanomaterial sprayed from the nozzle 20 toward the sample 10 can be monitored favorably in the passage region. Whether or not the above-described spraying condition that one or zero particles of the nanomaterial are contained in each individual droplet is realized can thereby be evaluated during the electrostatic spraying of the dispersion liquid 13 as well.

Furthermore, with the configuration example shown in FIG. 12, a detection signal, indicating a result of detection of light from the nanomaterial by the photodetection device 57, is input into an analyzing device 58, and necessary data analysis concerning the aggregation state of the nanomaterial and evaluation of the aggregation state of the nanomaterial are performed in the analyzing device 58. The immobilization controller 45, functioning as the voltage controller, references the aggregation state monitoring results input from the analyzing device 58 and controls the electrostatic spraying voltage applied between the nanomaterial dispersion liquid 13 and the sample 10 by the voltage applying device 40 (voltage controlling step).

The conditions of electrostatic spraying of the dispersion liquid 13 from the nozzle 20 can thereby be feedback controlled favorably and automatically based on the nanomaterial aggregation state monitoring result acquired by the aggregation state monitoring unit 55. Such feedback control of the electrostatic spraying voltage may be configured to be performed manually while referencing the monitoring results by an operator.

As the monitoring light used to monitor the nanomaterial aggregation state, for example, continuous light of a wavelength of 400 nm to 700 nm can be used favorably. As the monitoring light source 56, a light source capable of focusingly irradiating the passage region of the nanomaterial sprayed from the nozzle 20 with the monitoring light is preferable. As such a light source, a laser light source, a semiconductor laser light source, an LED light source, etc., can be cited.

Monitoring of the nanomaterial aggregation state by the aggregation state monitoring unit 55 shall be described further. As described above, in the aggregation state monitoring using the light supplied from the light source 56, the spatial region in which the charged nanomaterial moves through the atmosphere toward the sample 10 is irradiated with the monitoring light, and the scattered light, fluorescence, or other light generated by the nanomaterial in the process of passing through the monitoring light irradiation region is detected by the photodetection device 57 to monitor the nanomaterial aggregation state.

In regard to the scattered light from the nanomaterial, forward scattered light, side scattered light, backward scattered light, or a combination of these is preferably measured. Especially, in a case of monitoring the passage of nanomaterial of a size of approximately several dozen nm, the aggregation state can be monitored favorably by measuring the backward scattered light. In a case of monitoring the passage of nanomaterial of a size not more than 10 nm, the aggregation state can be monitored favorably by measuring fluorescence generated based on a quantum effect of the nanomaterial. The layout of the monitoring light source 56 and the photodetection device 57 with respect to the passage region of the nanomaterial to be monitored is preferably set according to the type of light from the nanomaterial to be used to monitor the aggregation state, a measuring distance, a measuring angle (forward, side, backward, etc.), and other measurement conditions.

Figure 13:
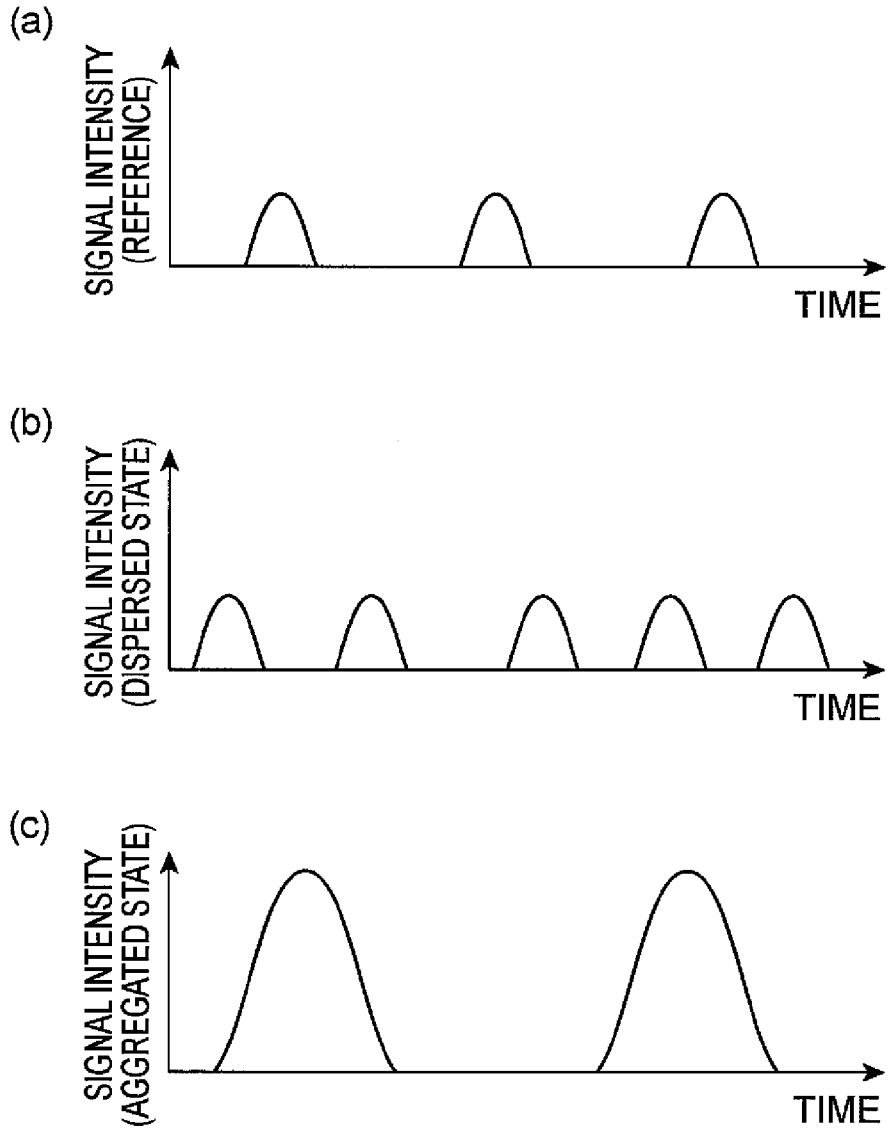
FIG. 13 shows diagrams concerning monitoring of an aggregation state of a nanomaterial by monitoring light.
Figure 14:
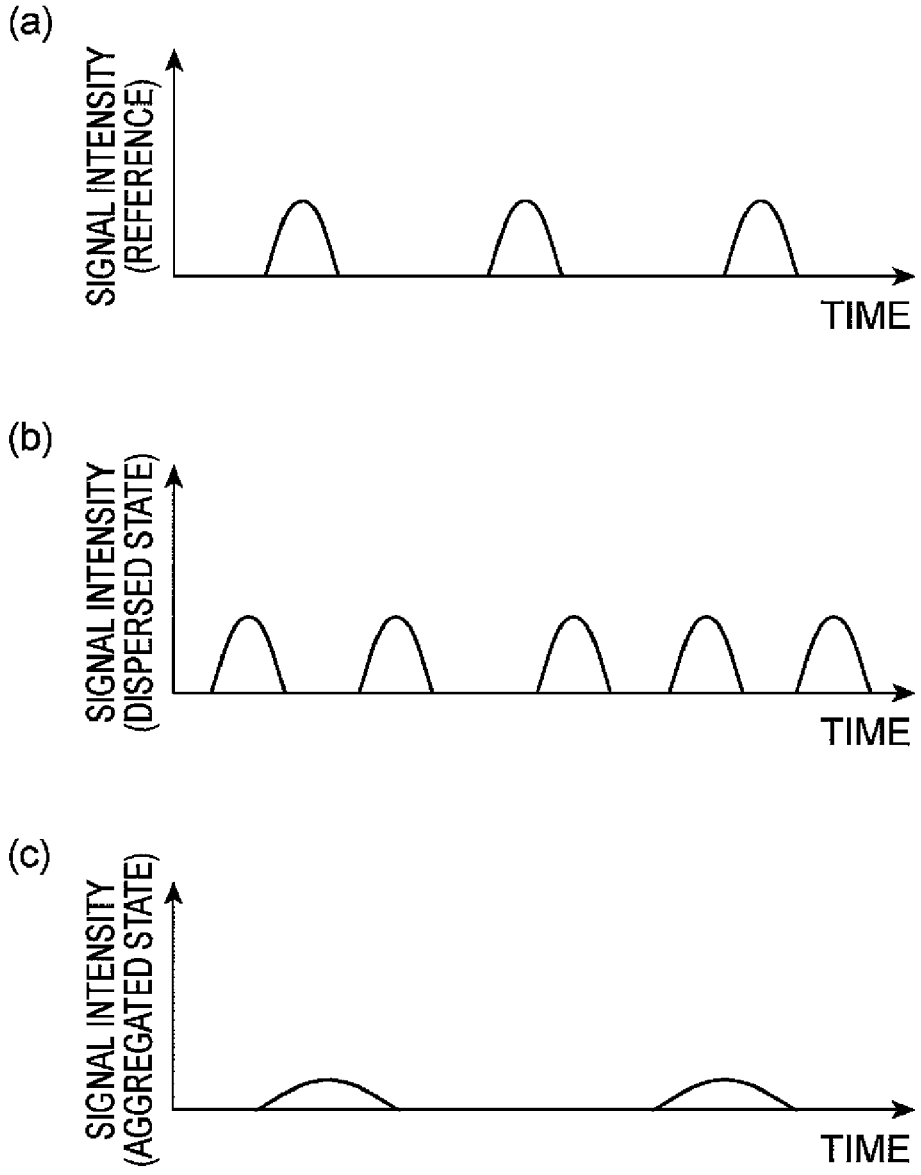
FIG. 14 shows diagrams concerning monitoring of an aggregation state of a nanomaterial by monitoring light.
Figure 15:
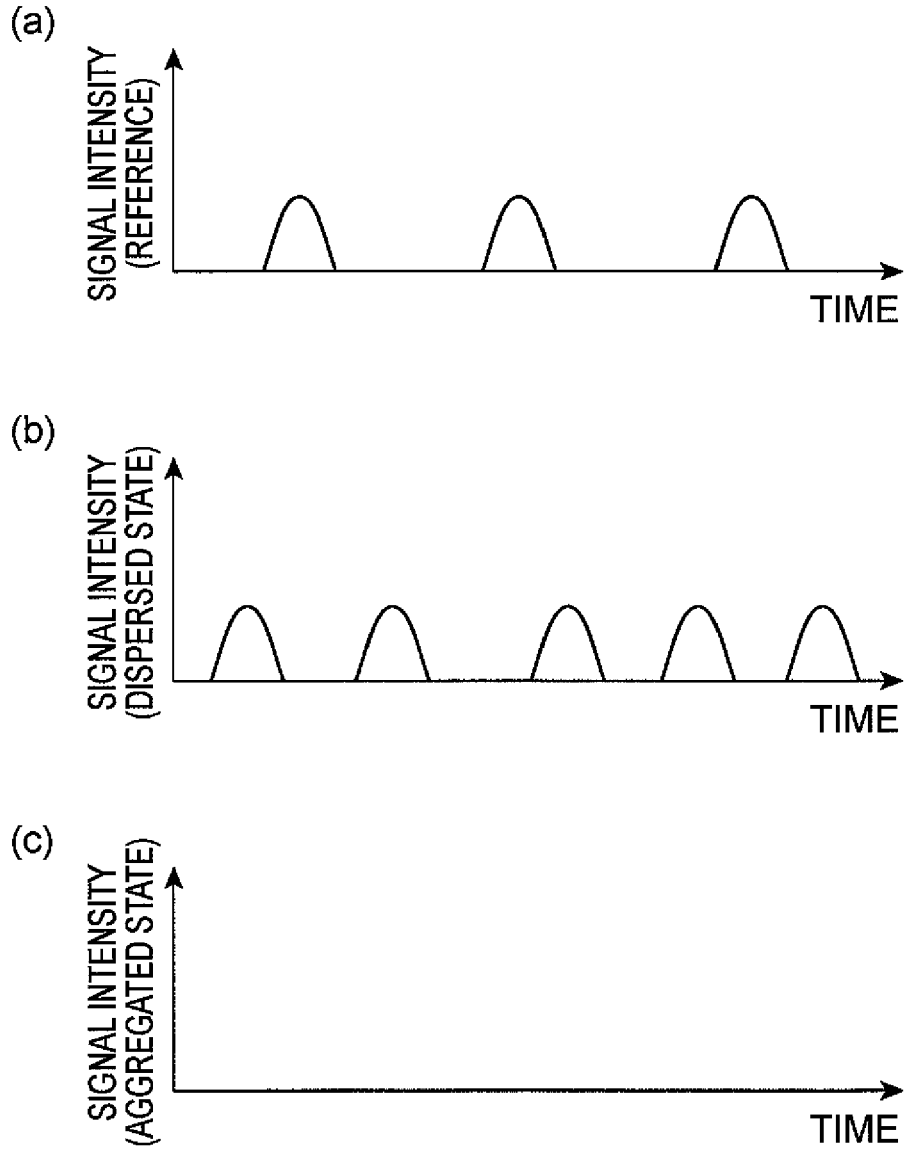
FIG. 15 shows diagrams concerning monitoring of an aggregation state of a nanomaterial by monitoring light.

FIGS. 13 to 15 show schematic diagrams concerning monitoring of the nanomaterial aggregation state by the monitoring light. In FIGS. 13 to 15, graphs (a) show reference data used for the monitoring of the nanomaterial aggregation state, graphs (b) show measurement data obtained when the nanomaterial is in a well-dispersed state, and graphs (c) show measurement data obtained when the nanomaterial is in an aggregated state.

FIG. 13 shows a method for monitoring the aggregation state using forward scattered light from the nanomaterial. In this example, first, as shown in the graph (a), a nanomaterial dispersion liquid for reference data acquisition, which is extremely low in concentration and is considered to be in a well-dispersed state of the nanomaterial, is prepared, the reference dispersion liquid is irradiated with the monitoring light, and reference data on forward scattered light are acquired in advance. Then, with the nanomaterial dispersion liquid 13 with which the immobilization process is to be actually performed, the passage region of the nanomaterial is irradiated with the monitoring light during execution of electrostatic spraying and forward scattered light measurement data are acquired. The measurement data acquired and the reference data are then compared automatically by the analyzing device 58 or manually by an operator to judge the nanomaterial aggregation state.

Referring to the graph (b) in FIG. 13, when the nanomaterial is in a well-dispersed state, forward scattered light signal intensities (scattering intensities by the nanomaterial) that are observed in a discrete manner according to passage of the nanomaterial are approximately equivalent to peak signal intensities in the reference data of the graph (a). On the other hand, as shown in the graph (c), when the nanomaterial is in an aggregated state, because particle diameters are made large by the forming of aggregates, the forward scattered light signal intensities increase in comparison to the reference data.

FIG. 14 shows a method for monitoring the aggregation state using side scattered light or backward scattered light from the nanomaterial. Referring to the graph (b) in FIG. 14, when the nanomaterial is in a well-dispersed state, side or backward scattered light signal intensities that are observed in a discrete manner are approximately equivalent to those in the reference data of the graph (a). On the other hand, as shown in the graph (c), when the nanomaterial is in an aggregated state, due to formation of aggregates, the side or backward scattered light signal intensities decrease in comparison to the reference data opposite to the forward scattered light.

FIG. 15 shows a method for monitoring the aggregation state using fluorescence from the nanomaterial. Referring to the graph (b) in FIG. 15, when the nanomaterial is in a well-dispersed state, fluorescence signal intensities that are observed in a discrete manner are approximately equivalent to those in the reference data of the graph (a). On the other hand, as shown in the graph (c), when the nanomaterial is in an aggregated state, the quantum effect of the nanomaterial disappears by the formation of aggregates, and the fluorescence signal intensities decrease or disappear in comparison to the reference data.

As shown by the examples of FIGS. 13 to 15, by irradiating the passage region of the nanomaterial from the nozzle 20 to the sample 10 with the monitoring light, measuring the scattered light or the fluorescence generated from the nanomaterial, and comparing the acquired measurement data with the reference data, the dispersion state or aggregation state of the nanomaterial can be monitored optically during execution of the immobilization process from changes of the signal intensities, etc.

In a case where the nanomaterial is judged to be in an aggregated state, by adjusting the value of the electrostatic spraying voltage applied to the dispersion liquid 13 by the voltage applying device 40, the nanomaterial immobilization process can be executed while maintaining a well-dispersed state. For example, in a case where it is judged that the sprayed droplets are large due to the application voltage applied to the dispersion liquid 13 being too high and that aggregation of the nanomaterial is occurring consequently, the immobilization process conditions can be adjusted by lowering the applied voltage within a range in which the electrostatic spraying itself is not stopped.

The nanomaterial immobilization apparatus and nanomaterial immobilization method according to the present invention are not restricted to the above-described embodiments and configuration examples, and various modifications are possible. For example, in regard to the configuration of the nanomaterial immobilization apparatus and the configuration of the electrostatic spray nozzle used in the immobilization apparatus, etc., various specific configurations besides those of the above-described configuration examples may be employed as long as the above-described immobilization conditions can be realized.

Here, with the nanomaterial immobilization method according to the above-described embodiments, the configuration of the immobilization method for immobilizing the nanomaterial on the sample that includes: (1) the dispersion liquid introducing step of using the electrostatic spray nozzle, including the nozzle body, having the tubular structure capable of storing, in the interior thereof, the nanomaterial dispersion liquid, in which the nanomaterial is dispersed in the solvent, and having disposed, at the tip thereof, the dispersion liquid spray outlet for electrostatically spraying the nanomaterial dispersion liquid, to introduce the nanomaterial dispersion liquid into the interior of the nozzle body; (2) the sample setting step of setting the sample, which is the target of nanomaterial immobilization, so as to oppose the dispersion liquid spray outlet of the electrostatic spray nozzle; (3) the spraying step of applying the voltage between the nanomaterial dispersion liquid and the sample and electrostatically spraying the nanomaterial dispersion liquid onto the sample from the dispersion liquid spray outlet of the electrostatic spray nozzle under the condition where one or zero particles of the nanomaterial are contained in each individual droplet sprayed; (4) the drying step of subjecting each individual droplet of the nanomaterial dispersion liquid sprayed from the electrostatic spray nozzle to drying of the solvent contained in the droplet in a spray atmosphere; and (5) the immobilizing step of immobilizing the nanomaterial on the sample by electrostatically depositing the nanomaterial, in the state in which the solvent of the nanomaterial dispersion liquid has been dried, onto the surface of the sample; is employed.

With the nanomaterial immobilization apparatus according to the above-described embodiments, the configuration of the immobilization apparatus that immobilizes the nanomaterial onto the sample and includes: (a) the electrostatic spray nozzle, including the nozzle body, having the tubular structure capable of storing, in the interior thereof, the nanomaterial dispersion liquid, in which the nanomaterial is dispersed in the solvent, and having disposed, at the tip thereof, the dispersion liquid spray outlet for electrostatically spraying the nanomaterial dispersion liquid; (b) the sample support, supporting the sample that is the target of nanomaterial immobilization so as to oppose the dispersion liquid spray outlet of the electrostatic spray nozzle; and (c) the voltage applying unit, applying an electrostatic spraying voltage between the nanomaterial dispersion liquid and the sample; and wherein (d) in electrostatically spraying the nanomaterial dispersion liquid from the dispersion liquid spray outlet of the electrostatic spray nozzle to the sample, the voltage applying unit applies the voltage so as to achieve the condition where one or zero particles of the nanomaterial are contained in each individual droplet sprayed, and (e) the electrostatic spray nozzle and the sample support are disposed so that with each individual droplet of the nanomaterial dispersion liquid sprayed from the electrostatic spray nozzle, the solvent contained in the droplet is dried in the spray atmosphere and the nanomaterial is electrostatically deposited on the surface of the sample in the state where the solvent of the nanomaterial dispersion liquid has dried to immobilize the nanomaterial on the sample, is employed.

Preferably in the above-described configuration, the immobilization method includes the aggregation state monitoring step of optically monitoring the aggregation state of the nanomaterial in the passage region of the nanomaterial sprayed toward the sample from the electrostatic spray nozzle. Likewise, the immobilization apparatus preferably includes the aggregation state monitoring unit, optically monitoring the aggregation state of the nanomaterial in the passage region of the nanomaterial sprayed toward the sample from the electrostatic spray nozzle.

By thus optically monitoring the aggregation state of the nanomaterial, which is sprayed from the electrostatic spray nozzle and with which the solvent is dried in the atmosphere, in the nanomaterial passage region between the spray outlet of the nozzle and the sample, the aggregation state of the nanomaterial that is immobilized on the sample can be evaluated during execution of the immobilization process.

In regard to a specific configuration for monitoring the aggregation state of the nanomaterial in the above-described manner, preferably with the immobilization method, the nanomaterial passage region is irradiated with the monitoring light, and at least one of either scattered light or fluorescence from the nanomaterial generated by the monitoring light is detected to optically monitor the aggregation state in the aggregation state monitoring step. Likewise, preferably with the immobilization apparatus, the aggregation state monitoring unit includes: the monitoring light source, irradiating the nanomaterial passage region with the monitoring light; and the photodetection unit, optically monitoring the aggregation state by detecting at least one of either scattered light or fluorescence from the nanomaterial generated by the monitoring light.

By thus monitoring the aggregation state using the scattered light or fluorescence generated upon irradiating the nanomaterial with the monitoring light in accordance with specific immobilization conditions, such as the size of the nanomaterial to be subject to the immobilization process, etc., the aggregation state of the charged nanomaterial sprayed toward the sample from the electrostatic spray nozzle can be optically monitored favorably in the passage region.

The immobilization method may include the voltage controlling step of controlling, based on the aggregation state monitoring result by the aggregation state monitoring step, the electrostatic spraying voltage applied between the nanomaterial dispersion liquid and the sample in the spraying step. Likewise, the immobilization apparatus may include the voltage controller, controlling, based on the aggregation state monitoring result by the aggregation state monitoring unit, the electrostatic spraying voltage applied between the nanomaterial dispersion liquid and the sample by the voltage applying unit.

The conditions of electrostatic spraying of the nanomaterial dispersion liquid from the nozzle can thereby be feedback controlled favorably and automatically based on the nanomaterial aggregation state monitoring result acquired by the aggregation state monitoring unit. Such feedback control of the electrostatic spraying voltage may be configured to be performed manually while referencing the nanomaterial aggregation state monitoring results by an operator.

Also, the immobilization method preferably includes the photodispersing step of irradiating the nanomaterial dispersion liquid in the interior of the nozzle body with the photodispersion laser light for dispersing the aggregated nanomaterial. Likewise, the immobilization apparatus preferably includes the photodispersion laser light source, irradiating the nanomaterial dispersion liquid in the interior of the nozzle body with photodispersion laser light for dispersing the aggregated nanomaterial. Aggregation of the nanomaterial immobilized on the sample can thereby be suppressed even more reliably.

In regard to the nozzle used for electrostatic spraying of the nanomaterial dispersion liquid, the inner diameter at the tip of the tubular structure of the nozzle body is preferably not more than 50 μm. By thus making the inner diameter of the tip of the nozzle body that is to be the nozzle bore diameter at the dispersion liquid spray outlet small and not more than 50 μm, it becomes possible to make the microdroplets of the dispersion liquid sprayed adequately small and favorably realize the above-described immobilization condition where one or zero particles of the nanomaterial are contained in each individual droplet.

The present invention is applicable as a nanomaterial immobilization method and a nanomaterial immobilization apparatus with which aggregation of a nanomaterial can be suppressed to favorably immobilize the nanomaterial on a sample.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A nanomaterial immobilization apparatus immobilizing a nanomaterial on a sample comprising:

an electrostatic spray nozzle, comprising a nozzle body, having a tubular structure capable of storing, in an interior thereof, a nanomaterial dispersion liquid, in which a nanomaterial is dispersed in a solvent, and having a dispersion liquid spray outlet, provided at a tip of the tubular structure, for electrostatically spraying the nanomaterial dispersion liquid;

a sample support, supporting a sample, which is a target of nanomaterial immobilization so as to oppose the dispersion liquid spray outlet of the electrostatic spray nozzle;

a voltage applying unit, applying an electrostatic spraying voltage between the nanomaterial dispersion liquid and the sample; and an aggregation state monitoring unit, optically monitoring an aggregation state of the nanomaterial in a passage region of the nanomaterial sprayed toward the sample from the electrostatic spray nozzle; and wherein, in electrostatically spraying the nanomaterial dispersion liquid from the dispersion liquid spray outlet of the electrostatic spray nozzle to the sample, the voltage applying unit applies the voltage so as to achieve a condition where one or zero particles of the nanomaterial are contained in each individual droplet sprayed, and the electrostatic spray nozzle and the sample support are disposed so that with each individual droplet of the nanomaterial dispersion liquid sprayed from the electrostatic spray nozzle, the solvent contained in the droplet is dried in a spray atmosphere and the nanomaterial is electrostatically deposited on a surface of the sample in a state where the solvent of the nanomaterial dispersion liquid has dried to immobilize the nanomaterial on the sample, and the aggregation state monitoring unit comprises: a monitoring light source, irradiating the passage region of the nanomaterial with monitoring light; and a photodetection unit, optically monitoring the aggregation state by detecting at least one of either scattered light or fluorescence from the nanomaterial generated by the monitoring light.

2. The nanomaterial immobilization apparatus according to claim 1, further comprising a voltage controller, controlling, based on the aggregation state monitoring result by the aggregation state monitoring unit, the electrostatic spraying voltage applied between the nanomaterial dispersion liquid and the sample by the voltage applying unit.

3. The nanomaterial immobilization apparatus according to claim 1, further comprising a photodispersion laser light source, irradiating the nanomaterial dispersion liquid in the interior of the nozzle body with photodispersion laser light for dispersing the aggregated nanomaterial.

4. The nanomaterial immobilization apparatus according to claim 1, wherein an inner diameter at the tip of the tubular structure of the nozzle body is not more than 50 μm.

5. A nanomaterial immobilization apparatus immobilizing a nanomaterial on a sample comprising:

an electrostatic spray nozzle, comprising a nozzle body, having a tubular structure capable of storing, in an interior thereof, a nanomaterial dispersion liquid, in which a nanomaterial is dispersed in a solvent, and having a dispersion liquid spray outlet, provided at a tip of the tubular structure, for electrostatically spraying the nanomaterial dispersion liquid;

a sample support, supporting a sample, which is a target of nanomaterial immobilization so as to oppose the dispersion liquid spray outlet of the electrostatic spray nozzle;

a voltage applying unit, applying an electrostatic spraying voltage between the nanomaterial dispersion liquid and the sample; and a photodispersion laser light source, irradiating the nanomaterial dispersion liquid in the interior of the nozzle body with photodispersion laser light for dispersing the aggregated nanomaterial; and wherein, in electrostatically spraying the nanomaterial dispersion liquid from the dispersion liquid spray outlet of the electrostatic spray nozzle to the sample, the voltage applying unit applies the voltage so as to achieve a condition where one or zero particles of the nanomaterial are contained in each individual droplet sprayed, and the electrostatic spray nozzle and the sample support are disposed so that with each individual droplet of the nanomaterial dispersion liquid sprayed from the electrostatic spray nozzle, the solvent contained in the droplet is dried in a spray atmosphere and the nanomaterial is electrostatically deposited on a surface of the sample in a state where the solvent of the nanomaterial dispersion liquid has dried to immobilize the nanomaterial on the sample.

* * * * *